US009664421B1

(12) United States Patent
El-Shaarawi

(10) Patent No.: US 9,664,421 B1
(45) Date of Patent: May 30, 2017

(54) LOW-TEMPERATURE SOLAR-THERMAL COOLING SYSTEM EMPLOYING FLUOROCARBON REFRIGERANTS AND A METHOD THEREOF

(71) Applicant: KING FAHD UNIVERSITY OF PETROLEUM AND MINERALS, Dhahran (SA)

(72) Inventor: Maged Ahmed El-Shaarawi, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 14/984,835

(22) Filed: Dec. 30, 2015

(51) Int. Cl.
*F25B 27/00* (2006.01)
*F25B 27/02* (2006.01)
*F25B 31/00* (2006.01)

(52) U.S. Cl.
CPC ..... *F25B 27/005* (2013.01); *F25B 27/00* (2013.01); *F25B 27/02* (2013.01); *F25B 31/006* (2013.01); *F25B 31/008* (2013.01); *F25B 2400/16* (2013.01); *F25B 2400/24* (2013.01)

(58) Field of Classification Search
CPC F25B 27/005; F25B 2400/24; F25B 2400/16; F25B 27/002; F25B 27/00; F25B 27/02; F25B 31/008; F25B 31/006
USPC ..... 62/235.1; 417/209
See application file for complete search history.

(56) References Cited

U.S. PATENT DOCUMENTS 4,246,956 A * 1/1981 Drucker ..... F24D 11/0264 126/640
4,537,041 A * 8/1985 Denpou ..... F25B 5/00 62/199
5,636,528 A * 6/1997 Sasaki ..... F25B 6/04 62/506
2008/0047285 A1 2/2008 Boule
2011/0197609 A1* 8/2011 Ooi ..... F25B 41/043 62/222
2011/0219801 A1* 9/2011 McKenzie ..... F25B 27/005 62/235.1
2014/0047860 A1* 2/2014 Spatz ..... C09K 5/045 62/498
2014/0223945 A1 8/2014 Rahl
2016/0201658 A1* 7/2016 Arapkoules ..... F04B 19/24 417/53

FOREIGN PATENT DOCUMENTS

DE 10 2010 056 490 A1 7/2012
EP 2 669 585 A1 12/2013

OTHER PUBLICATIONS

Green Energy Blog, "Solar Thermal Systems", URL: http://cleangreenenergyzone.com/solar-energy/solar-thermal-systems/, 4 Pages total, (2015).

* cited by examiner

*Primary Examiner* — David Teitelbaum
(74) *Attorney, Agent, or Firm* — Oblon, McClelland, Maier & Neustadt, L.L.P.

(57) ABSTRACT

A solar-thermal refrigerant compression system employing refrigerants, such as R410a and R500, and a method of employing the system in refrigeration and air-conditioning units. The system includes a refrigerant storage tank, an evaporator, a mixing chamber, a condenser and an isochoric thermal compressor comprising a condensate heat exchanger and a heating coil connected to a solar collector field.

19 Claims, 37 Drawing Sheets

LOW-TEMPERATURE SOLAR-THERMAL COOLING SYSTEM EMPLOYING FLUOROCARBON REFRIGERANTS AND A METHOD THEREOF

BACKGROUND OF THE INVENTION

Technical Field

The present invention relates to a solar-thermal refrigerant compression system employing classical refrigerants and a method of providing a cooling effect with the system.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

The sorption technique (liquid-vapor absorption and solid-vapor adsorption) is the most commonly used technique in solar-driven air conditioning and refrigeration systems. However, the sorption technique needs special refrigerants, such as ammonia, methanol and water, because most of the classical refrigerants (i.e. fluorocarbons) are incompatible with this technique. In addition, the sorption cooling systems are bulky and expensive.

U.S. patent application (2014/0223945A1) discloses a solar thermal air conditioning unit that can be used with fluorocarbon and CFC refrigerants. The unit has a compressor compressing a refrigerant gas to form a compressed refrigerant, which flows to condensers and then an evaporator.

Patent applications (U.S. 2008/0047285A1, E.P. 2669585A1 and DE 102010056490A1) disclose various solar thermal air conditioning and/or heating systems using either ammonia/water systems, water/glycol systems, or methanol/ethanol refrigerants.

In view of the foregoing, the objective of the present invention is to provide a relatively compact and economical solar thermal-driven cooling system that does not employ a mechanical compressor and employs classical refrigerants such as fluorocarbons.

BRIEF SUMMARY OF THE INVENTION

According to a first aspect, the present disclosure relates to a solar thermal cooling system comprising: (i) a refrigerant storage tank, which stores a refrigerant liquid, (ii) an evaporator, which receives and evaporates a first portion of the refrigerant liquid from the refrigerant storage tank to form a refrigerant vapor, (iii) a mixing chamber, which receives the refrigerant vapor from the evaporator and a second portion of the refrigerant liquid from the refrigerant storage tank and mixes the refrigerant vapor with the second portion of the refrigerant liquid to form a mixture, (iv) an isochoric thermal compressor comprising a condensate heat exchanger and a heating coil fluidly connected to a solar collector field, wherein the isochoric thermal compressor receives and compresses the mixture by heating the mixture to form a compressed refrigerant, and (v) a condenser located between the isochoric thermal compressor and the refrigerant storage tank, wherein the condenser receives and condenses the compressed refrigerant to form a condensate that flows through the condensate heat exchanger to the refrigerant storage tank, wherein the condenser, the isochoric thermal compressor, the refrigerant storage tank, the evaporator, the mixing chamber are fluidly connected to one another, and the mixing chamber and the evaporator are connected in parallel to the refrigerant storage tank.

In one or more embodiments, the condenser has a working temperature ranging from 40-60° C.

In one or more embodiments, the refrigerant vapor and the refrigerant liquid are a blend of fluorocarbons, chlorofluorocarbons, or both.

In some embodiments, the refrigerant vapor and the refrigerant liquid are a zeotropic blend of difluoromethane and pentafluoroethane, or an azeotropic blend of dichlorodifluoromethane and 1,1-difluoroethane.

In one or more embodiments, the system can be employed in air conditioners in temperatures up to 50° C.

In some embodiments, the system produces a temperature of −2-10° C.

In one embodiment, the system further comprises a temperature control valve located between the solar collector field and the heating coil, wherein the temperature control valve controls the volume of a heating fluid flowing from the solar collector field to the heating coil.

In another embodiment, the system further comprises a pressure relief valve located between the isochoric thermal compressor and the condenser.

In one embodiment, the system further comprises a second throttle valve between the refrigerant storage tank and the evaporator, wherein the second throttle valve regulates the volume of the first portion of the refrigerant liquid flowing to the evaporator.

In another embodiment, the system further comprises a first throttle valve located between refrigerant storage tank and mixing chamber, wherein the first throttle valve regulates the volume of the second portion of the refrigerant liquid flowing to the mixing chamber.

In one embodiment, the system further comprises a check valve located between the mixing chamber and the isochoric thermal compressor.

According to a second aspect, the present disclosure relates to a solar thermal cooling method comprising: (i) storing a refrigerant liquid in a refrigerant storage tank, (ii) evaporating a first portion of the refrigerant liquid in an evaporator to form a refrigerant vapor, (iii) mixing a second portion of the refrigerant liquid with the refrigerant vapor in a mixing chamber to form a mixture, wherein the mixing chamber is fluidly connected to the evaporator, and the mixing chamber and the evaporator are fluidly connected in parallel to the refrigerant storage tank, (iv) compressing the mixture into a compressed refrigerant in an isochoric thermal compressor comprising a condensate heat exchanger and a heating coil, which is fluidly connected to a solar collector field, and (v) condensing the compressed refrigerant in a condenser to form a condensate, which flows through the condensate heat exchanger to the refrigerant storage tank.

In one or more embodiments, the condenser has a working temperature ranging from 40-60° C.

In one or more embodiments, the refrigerant vapor and the refrigerant liquid are a blend of fluorocarbons, chlorofluorocarbons, or both.

In some embodiments, the refrigerant vapor and the refrigerant liquid are a zeotropic blend of difluoromethane and pentafluoroethane, or an azeotropic blend of dichlorodifluoromethane and 1,1-difluoroethane.

In some embodiments, the method produces a temperature of −2-10° C.

In one or more embodiments, the method further comprises flowing a volume of a heating fluid from the solar collector field to the heating coil and controlling the volume with a temperature control valve located between the solar collector field and the heating coil.

In one embodiment, the method further comprises flowing a volume of the first portion of the refrigerant liquid to the evaporator and regulating the volume with a second throttle valve.

In another embodiment, the method further comprises flowing a volume of the second portion of the refrigerant liquid to the mixing chamber and regulating the volume with a first throttle valve.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
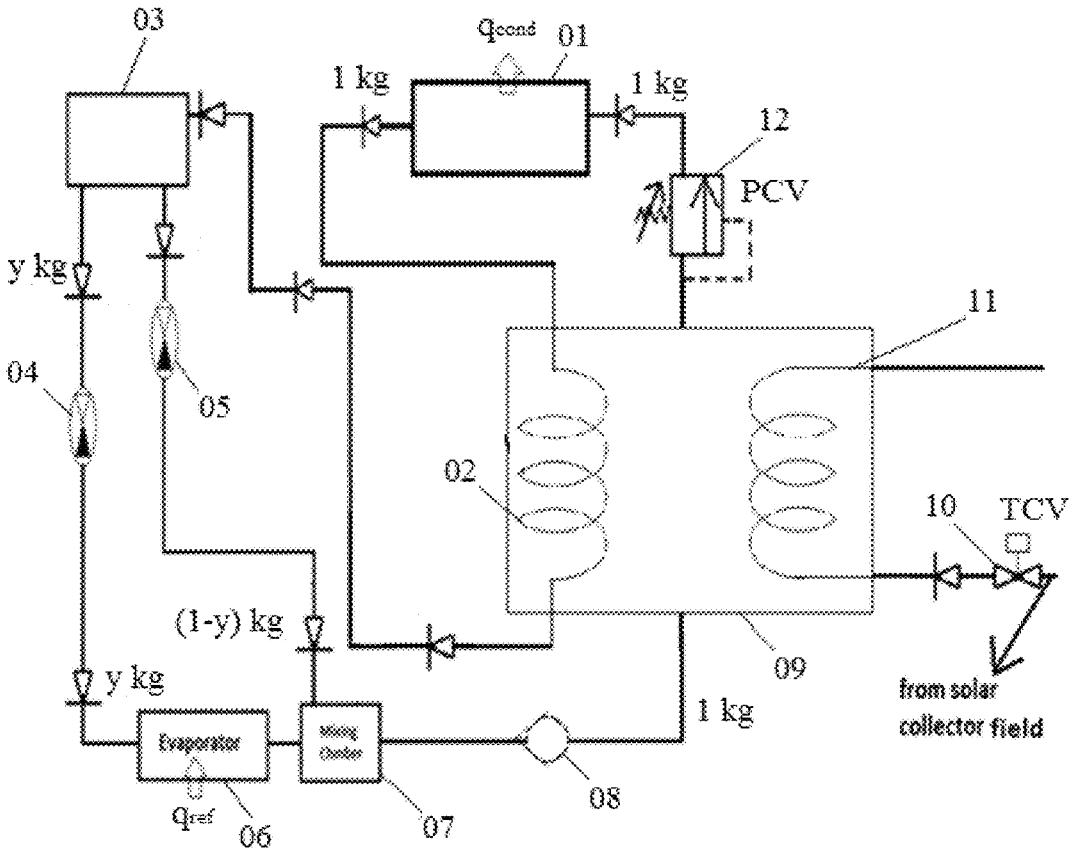
FIG. 1 shows a schematic of an embodiment of the low-temperature solar-thermal cooling system employing 1 kg of refrigerant fluid.

Embodiments of the present disclosure will now be described more fully hereinafter with reference to the accompanying drawings, in which some, but not all embodiments of the disclosure are shown.

This disclosure relates to a solar-thermal driven cooling system that employs the isochoric heating process instead of the isentropic/polytropic compression process in vapor compression system [M. A. I. El-Shaarawi, R. A. Ramadan, Solar Energy, Vol. 37, No. 5, 1986, pp. 347-361; M. A. I. El-Shaarawi, R. A. Ramadan, Energy Conversion and Management, Vol. 27, No. 1, 1987, pp. 73-81; M. A. 1. El-Shaarawi, S. A. M. Said, M. U. Siddiqui, International Journal of Refrigeration, Volume 41, May 2014, Pages 103-112; F. Trombe, M. Foex, J. Solar Energy, Vol. 1, 1957, pp. 51-52; D. A. Williams, R. Chung, G. O. G. Lof, D. A. Fester, J. A. Duffie, American Society of Mechanical Engineers (ASME) Paper No. 57-A-260, 1957; D. A. Williams, R. Chung, G. O. G. Lof, D. A. Fester, J. A. Duffie, Refrigeration Engineering, Vol. 66, 1958, pp. 33-37, pp. 64-66; M. M. Eisenstadt, F. M. Flanigan, E. A. Farber, American Society of Mechanical Engineers (ASME) Paper No. 59-A-276, 1959; J. C. V. Chinnapa, Solar Energy, Vol. 5, 1961, pp. 1-18; J. C. V. Chinnapa, Solar Energy, Vol. 6, 1962, pp. 143-150; J. A. Duffie et al., Mechanical Engineering, Vol. 85, August 1963, pp. 31-35; V. de Sa, Solar Energy, Vol. 8, 1964, pp. 83-90; M. A. I. El-Shaarawi, R. A. Ramadan, Solar and Wind Technology, Vol. 5, 1988, pp. 271-279; M. A. I. El-Shaarawi, R. A. Ramadan, Energy Conversion and Management, Vol. 28, No. 2, 1988, pp. 143-150; M. A. I. El-Shaarawi, S. A. M. Said, M. U. Siddiqui, International Journal of Air Conditioning and Refrigeration, 20 (2), 2012, Article #1250008; S. A. M. Said, M. A. I. El-Shaarawi, M. U. Siddiqui, Energy, 61, 2013, pp. 332-344; P. Ravikumar, P. Sivamurugan, International Journal of Advanced Engineering Research and Studies (IJAERS) Vol. 1, Issue 3, April-June, 2012, 12-15; P. Sivamurugan, P. Ravikumar, Applied Mechanics and Materials (Volumes 592-594), Main Theme Dynamics of Machines and Mechanisms, Industrial Research, Chapter 5: Thermodynamics and Thermal Engineering, Fuel and Diesel, 2014, pp. 1443-1447; A. A. A. Attia, Solar Energy 2012; 86: 2486-93—each incorporated herein by reference in its entirety]. One advantage of this solar-thermal cooling system is that it utilizes low grade thermal energy instead of high grade mechanical shaft work to drive the compressor. Therefore, in a preferred embodiment the solar-thermal cooling system does not include mechanical compressors and/or ejector-compressors, making it more economical than the mechanical vapor compression system. The solar-thermal cooling system of the present disclosure is less bulky and can possess a higher coefficient of performance than sorption systems. And unlike sorption systems which utilize special refrigerants, such as ammonia, methanol and/or water, the solar-thermal cooling system utilizes classical fluorocarbon refrigerants in the vapor compression system. The present disclosure is suitable for refrigeration applications, such as refrigerated food display cabinets, that require temperatures not lower than −2° C., preferably in a range of −2° C. to 10° C., and also air-conditioning systems of different sizes, such as large commercial cooling systems and personal cooling systems.

FIG. 1 is a schematic of an embodiment of the present disclosure. As shown in FIG. 1, and in other embodiments of the invention, several components of the system may be commercially available and well known to those skilled in the art. The components may also be directly connected to one another, for example, by connecting pipes, without intervening components. Also, valves may be disposed in a variety of ways, for example, between portions of connecting pipes, or for example, integrally to other system components. As used herein, the term "fluid" refers to a liquid, a gas or a mixture thereof.

The vapor of the refrigerant is condensed in the condenser 01. Non-limiting examples of a refrigerant include ammonia, a fluorocarbon, a chlorofluorocarbon, and a mixture thereof [M. S. Owen, ASHRAE Handbook Fundamentals, 2009, Pages 35-45—incorporated herein by reference in its entirety]. Preferred refrigerants include R410a, a zeotropic blend of 50 vol % difluoromethane and 50 vol % pentafluoroethane, and R500, an azeotropic blend of 73.8 vol % dichlorodifluoromethane and 26.2 vol % 1,1-difluoroethane. The refrigerant R410a has a critical temperature of 72.8° C. and a critical pressure of 4.86 MPa. The refrigerant R500 has a critical temperature of 102.1° C. and a critical pressure of 4.17 MPa. As used herein, the term "critical temperature" of the refrigerant refers the temperature at and above which vapor of the refrigerant cannot be liquefied, no matter how much pressure is applied. As used herein, the term "critical pressure" of the refrigerant refers the pressure to liquefy a refrigerant vapor at its critical temperature.

The condenser 01 has a working temperature that is up to 20° C. above the ambient temperature, preferably up to 15° C., more preferably up to 10° C., preferably from 2 to 8° C. above the ambient temperature, in order to have a driving temperature difference in the condenser for the cooling heat transfer process preferably by ambient air during the condensation process. In an embodiment, cooling water is used to draw heat out of the condenser. In another embodiment, the temperature of the cooling water is at least 3-5° C. less than the condenser temperature. In selected embodiments, evaporative condensers might be employed. The ambient temperature ranges from 30-50° C., hence the condenser working temperature is preferably 40-60° C. In addition, the temperature of the condensate exiting the condenser is selected to be up to 15° C. above the temperature of the evaporator, preferably up to 12° C., more preferably up to 10° C., preferably from 2 to 8° C. above the temperature of the evaporator.

The condenser 01 may be constructed of a material such as metal, plastic, or glass, for example, that can withstand the temperatures and pressures associated with condensing refrigerant vapor and that is compatible with the particular refrigerant used in the system. Preferably, the condenser comprises copper.

The condenser acts as a source of refrigerant for the refrigerant storage tank 03, preferably by gravity feed, with 1-20 kg of condensate, preferably 1-10 kg, more preferably 1-5 kg of condensate, to satisfy the instantaneous cooling load. The refrigerant storage tank may be constructed of a material, such as metal, plastic, or glass, for example, that can withstand the temperatures and pressures associated with storing liquid refrigerant and that is compatible with the particular refrigerant used in the system. In an embodiment, a refrigerant storage tank may have a single outlet that branches into two or more lines to feed the condensate into the evaporator and the mixing chamber. In another embodiment, a refrigerant storage tank may have multiple outlets. In a preferred embodiment, the refrigerant storage tank has two outlets. Two streams of the refrigerant leave the refrigerant storage tank: a first portion of refrigerant liquid is extracted from the refrigerant storage tank into the evaporator 06 after throttling it in a second throttle valve 03, and a second portion of refrigerant liquid is extracted from the refrigerant storage tank into the mixing chamber after throttling it in a first throttle valve 05. Non-limiting examples of throttling valves include thermostatic expansion valves and float valves.

The first portion of refrigerant liquid enters the evaporator 06. An extraction ratio, y, is a mass fraction of the mass of the first portion relative to the total mass of the refrigerant liquid in the refrigerant storage tank. The term "y" ranges from 0.3-0.9, preferably 0.3-0.7, more preferably 0.3-0.5.

The evaporator 06 evaporates the refrigerant liquid that exists within the throttled refrigerant and forms a refrigerant vapor and may be constructed of a material, such as metal, plastic, or glass, for example, that can withstand the temperatures and pressures associated with evaporating liquid refrigerant to form the refrigerant vapor and that is compatible with the particular refrigerant used in the system. The evaporator may be a bare-tube evaporator, plate surface evaporator or a finned evaporator. The temperature of the evaporator, and hence the refrigeration temperature, ranges from −10° C. to 10° C., preferably −5° C. to 10° C., more preferably −2 to 10° C. when the temperature of air in the exterior is in a range of 30-50° C. As used herein, the term "refrigeration temperature" refers to the temperature of the cooled space in the vicinity of the evaporator.

The second portion of refrigerant liquid enters the mixing chamber, where the refrigerant liquid is mixed with the refrigerant vapor from the evaporator to form a mixture of a suitable quality, $x_5$, for thermal compression. The mass of the second portion is expressed as a mass fraction of the total mass of the refrigerant liquid coming out of the condenser. The mass fraction of the second portion is 0.1-0.6, preferably 0.3-0.7, more preferably 0.5-0.7 of the total mass of the refrigerant fluid in the system. As used herein, "quality" refers to a mass fraction of the mass of the vapor to the total mass of the mixture. For example, a low quality refrigerant has a low vapor mass. In a preferred embodiment, a low quality refrigerant with a quality of 0.1-0.5, preferably 0.2-0.45, more preferably 0.25-0.4 is achieved by mixing the aforementioned mass fractions of the first and second portions of the refrigerant liquid. The mixing chamber may be constructed of a material such as metal, plastic, or glass, for example, that can withstand the temperatures and pressures associated with mixing a refrigerant vapor and a refrigerant liquid. Preferably, the mixing chamber is constructed from stainless steel. The mixing chamber is sized to accommodate 1-20 kg of refrigerant fluid (i.e. liquid and vapor), preferably 1-10 kg, more preferably 1-5 kg. The volume of the refrigerant fluid takes up 50-90% of the volume of the mixing chamber, preferably 60-80%, more preferably 70-80%. The mixing chamber has a shape of a cube, a cuboid, or preferably a cylinder. The cylindrical mixing chamber may have hemispherical ends.

The mixing chamber 07 may have one or multiple inlets. In a preferred embodiment, the mixing chamber has two inlets—a first inlet to receive the refrigerant vapor from the evaporator and a second inlet to receive the refrigerant liquid from the refrigerant storage tank. The inlets may be oriented parallel to each other on the same mixing chamber wall and may produce streams of refrigerant liquid and/or vapor parallel to the latitude of the cylinder. Preferably, the streams entering a cylindrical mixing chamber are parallel to the longitudinal axis of the cylinder. In another embodiment, the first inlet is installed on the body of the cylindrical mixing chamber while the second inlet is installed on the top of the cylinder. Each inlet may independently be a nozzle designed to inject the refrigerant liquid and vapor to result in turbulent mixing of the two phases in the mixing chamber. Non-limiting examples of nozzles include jet nozzles and high velocity nozzles. In a preferred embodiment, spray nozzles are used and the refrigerant liquid is sprayed in a radial direction to enable mixing with the refrigerant vapor. In another embodiment the refrigerant liquid is sprayed into the mixing chamber through an inlet that is oriented substantially perpendicular to the longitudinal axis of the cylinder. The refrigerant vapor is injected into the mixing chamber from an inlet is installed on the top of the cylinder. In this manner the refrigerant liquid forms a vortex inside the mixing chamber carried by the refrigerant vapor and the evaporate formed by the evaporation of the refrigerant liquid. The mixing of the refrigerant liquid and the refrigerant vapor may also be driven by a stirrer such as a mechanical stirrer or a magnetic stirrer.

In one embodiment, the mixing chamber has one outlet from which the resultant saturated liquid-vapor exits the mixing chamber. The outlet may be arranged on the top of the mixing chamber. Preferably, the outlet is arranged on the body of the cylindrical mixing chamber.

A check valve 08 is installed between the mixing chamber and isochoric thermal compressor to permit the mixture to flow to the isochoric thermal compressor only. Non-limiting examples of a check valve include a ball check valve, a diaphragm check valve, a swing check valve, a stop-check valve, a lift-check valve, an in-line check valve, a duckbill valve and a pneumatic non-return valve.

The resultant saturated liquid-vapor mixture from the mixing chamber 07 enters the isochoric thermal compressor 09, which thermally compresses the mixture in two steps. The isochoric thermal compressor may be constructed of a material such as metal or glass (e.g. Pyrex), for example, that can withstand the temperatures and pressures associated with compressing refrigerant vapor and/or liquid and that is compatible with the particular refrigerant used in the system. The isochoric thermal compressor is sized to accommodate 1-20 kg of refrigerant vapor, preferably 1-10 kg, more preferably 1-5 kg at a pressure ranging from 2-30 bar, preferably 4-25 bar, more preferably 4-18 bar. The condensate heat exchanger (CHE) coil 02 in the isochoric thermal compressor compresses the mixture in a first heating step by acting as a medium for heat transfer from the relatively warmer condensate flowing out of condenser and to the relatively cooler mixture flowing out of the evaporator/mixing chamber. The CHE may be any type of heat exchange device including shell and tube heat exchangers, plate heat exchangers, plate and fin heat exchangers and pipe coils. The condensate flows from the condenser, through the CHE and enters the storage tank.

Figure 24:
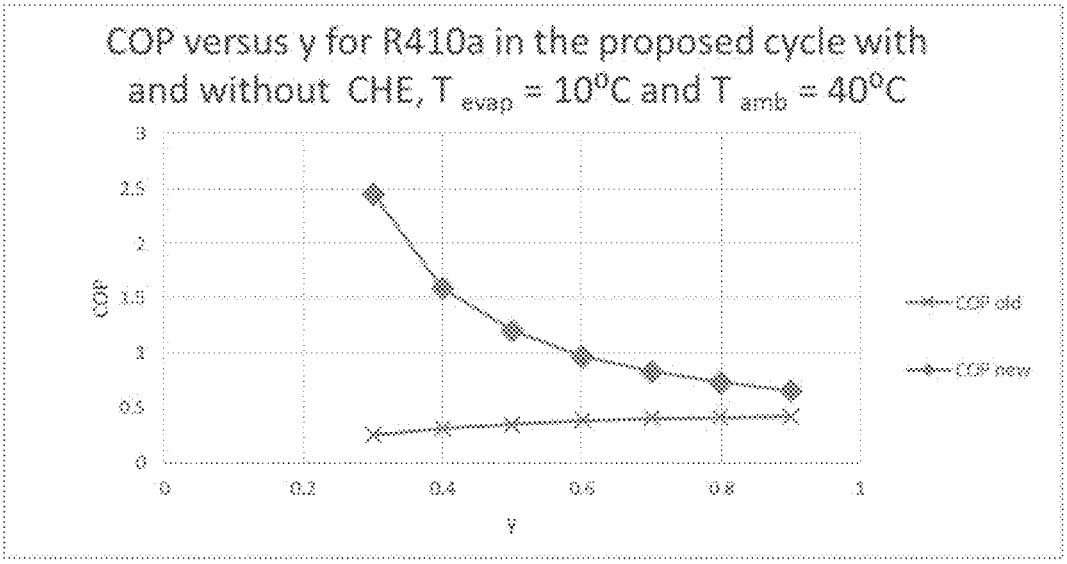
FIG. 24 shows the effect of the CHE on COP versus y for R410a, at evaporator temperature ($T_{evp}$) of 10° C. and ambient temperature ($T_{amb}$) of 40° C.

The first heating step raises the temperature and hence pressure of the mixture to a temperature and pressure that are between those of the condenser 01 and the evaporator 06. The liquid-condensate temperature is also reduced to below the ambient temperature but above the evaporator temperature. Thus, the CHE reduces the required heat input from the solar collector fields to drive the cycle and increases the evaporator's output refrigeration effect per kg of refrigerant. Therefore, the coefficient of performance of the present disclosure is increased. The inclusion of CHE in the present disclosure has three positive effects. Firstly, it reduces the required thermal energy input to drive the cycle and hence reduces the size and initial cost of the thermal driver needed. Secondly, it increases the refrigeration effect per kg of refrigerant in the evaporator. Thus, it increases the coefficient of performance of the cycle. The examples show a noticeable increase in the coefficient of performance due to the inclusion of CHE in the cycle. For example, at y=0.3, the coefficient of performance of the cycle with the CHE is 10 times higher than the coefficient of performance of the cycle without the CHE (FIG. 24). Thirdly, the cycle can be solar-driven using low-temperature solar collector fields and utilized for air conditioning with some of the known refrigerants, particularly R410a and R500, as the working substance. The inclusion of the CHE in the cycle increases the range of values of the extraction ratio y for which the solar energy can easily drive the system. The refrigeration cycle in the present disclosure, at low values of extraction ratio, y, has a coefficient of performance higher than any single-effect sorption system.

A solar heating coil 11 in the isochoric thermal compressor makes a second heating step that raises the pressure of the refrigerant to that of the condenser 01 and then feeds the thermally compressed refrigerant into the condenser 01 to complete the thermodynamic cycle. The solar heating coil is heated by a heating fluid from a solar collector field. A temperature controlled valve (TCV) 10 is disposed between the solar heating coil and the solar collector field to control the flow of a heating fluid from the solar collector field.

The isochoric thermal compressor 09 is equipped with a pressure relief valve 12 at the exit that has a setting value equal to the condenser pressure. Non-limiting examples of a pressure relief valve include an ASME I valve, an ASME VIII valve, a low lift safety valve, a full lift safety valve, a full bore safety valve, a balanced safety relief valve, a pilot-operated pressure relief valve, and a power-actuated pressure relief valve. Preferably, a conventional spring-loaded pressure relief valve is employed.

In an embodiment, during the daytime, heat is provided by a solar collector field which heats up a heating fluid for the heating coil. The thermodynamic cycle for the cooling system continues throughout the day as long as solar energy is available. Night may be defined in terms of the availability of sunlight, such that night refers to any time when sunlight is not available or insufficient to operate the system. Night may also be defined, for example, in terms of an amount of heat input available from a thermal collector. That is, night may be deemed to start even while the sun remains above the horizon, if the thermal collector stops providing sufficient heated fluid to the heating coil to produce refrigerant vapor. Night may be defined in terms of an ambient temperature, for example, where the opening or closing of one or more valves is governed by a thermostat. A solar collector according to an embodiment need not have a solar energy storage capacity for storing solar energy when sunlight is not available. Instead, the cooling system may continue refrigeration during nights and periods of low solar insolation (operate 24 hours a day) by incorporating a heat storage facility in the system [S. A. M. Said, M. A. I. El-Shaarawi, M. U. Siddiqui, International Journal of Refrigeration, 35, 2012, pp. 1967-1977; F. R. Siddiqui, M. A. I. El-Shaarawi, S. A. M. Said, Energy Conversion and Management, 80, 2014, pp. 165-172; Maged A I El-Shaarawi, Syed A. M. Said, Farooq R. Siddiqui, U.S. Pat. No. 8,881,539 B1, Nov. 11, 2014; A. A. Al-Ugla, M. A. I. El-Shaarawi, S. A. M. Said, International Journal of Refrigeration, 53, 2015, pp. 90-100—each incorporated herein by reference in its entirety]. The heat storage facility is preferably located in a sheltered building.

A solar collector according to an embodiment is a thermal collector, which comprises a heat exchanger, and may comprise any of various configurations of structures adapted for use with various heat sources, such as sunlight, exhaust gas, or geothermal heat, for example. A solar collector, according to an embodiment, converts energy from sunlight into thermal energy that can be used to perform work on a fluid. In various embodiments, a solar collector may have one or more of various geometries including a flat plate, arc, or compound parabolic curve, for example. In other embodiments, a solar collector may exploit optical or other properties of sunlight, including absorption, reflection, or refraction, for example, to harness useable energy from sunlight. Preferably the solar collector collects solar energy in the form of heat rather than in the form of electricity or electrical potential. For example, in an embodiment of the invention the solar collector is not a photovoltaic cell.

In an embodiment, solar energy can be the only heat source and no auxiliary heat source is necessary. In another embodiment, no additional thermal store is used anywhere in a thermal circuit comprising one or more thermal collectors and a generator. A solar collector according to an embodiment may have a solar collector fluid, for example water or another fluid suitable for operation as a medium for heat exchange, such as saline, antifreeze, or oil. A solar collector according to an embodiment may likewise be used to heat a fluid circulating in and out of the solar collector, for example water, or another fluid suitable for operation as a medium for heat exchange, such as saline, antifreeze, or oil.

The disclosure is also directed to a method of providing a refrigeration effect. The method includes storing the refrigerant liquid in the refrigerant storage tank, evaporating the first portion of the refrigerant liquid in an evaporator to form a refrigerant vapor, thereby producing a refrigeration effect which is employed for refrigeration purposes. The evaporator may be connected to a fan that blows air over the evaporator, and the refrigerant in the evaporator absorbs heat from the air to form cooled air. The cooled air may be distributed in a building and/or a refrigerator via ducts and/or blower systems. The mixing chamber is fluidly connected to the evaporator, and the mixing chamber and the evaporator are fluidly connected in parallel to the refrigerant storage tank. The refrigerant fluid flows at a rate of 0.2-0.6 kg/s, preferably 0.2-0.5 kg/s, more preferably 0.2-0.4 kg/s. Subsequent steps in the method include, mixing the second portion of the refrigerant liquid with the refrigerant vapor in a mixing chamber to form the mixture, compressing the mixture into a compressed refrigerant in the isochoric thermal compressor comprising the condensate heat exchanger and the heating coil, which is fluidly connected to a solar collector field.

At least one of the aforementioned elements of the system may be installed in cooling devices, which include air conditioners and refrigerators, to provide a refrigeration effect produced by the aforementioned method. For example, an air conditioner may house the evaporator, condenser, compressor, mixing chamber and refrigerant storage tank, while the solar collector is installed outside the building. In an embodiment employing a water-cooled condenser, the condenser is located outside of the air conditioner.

Figure 2:
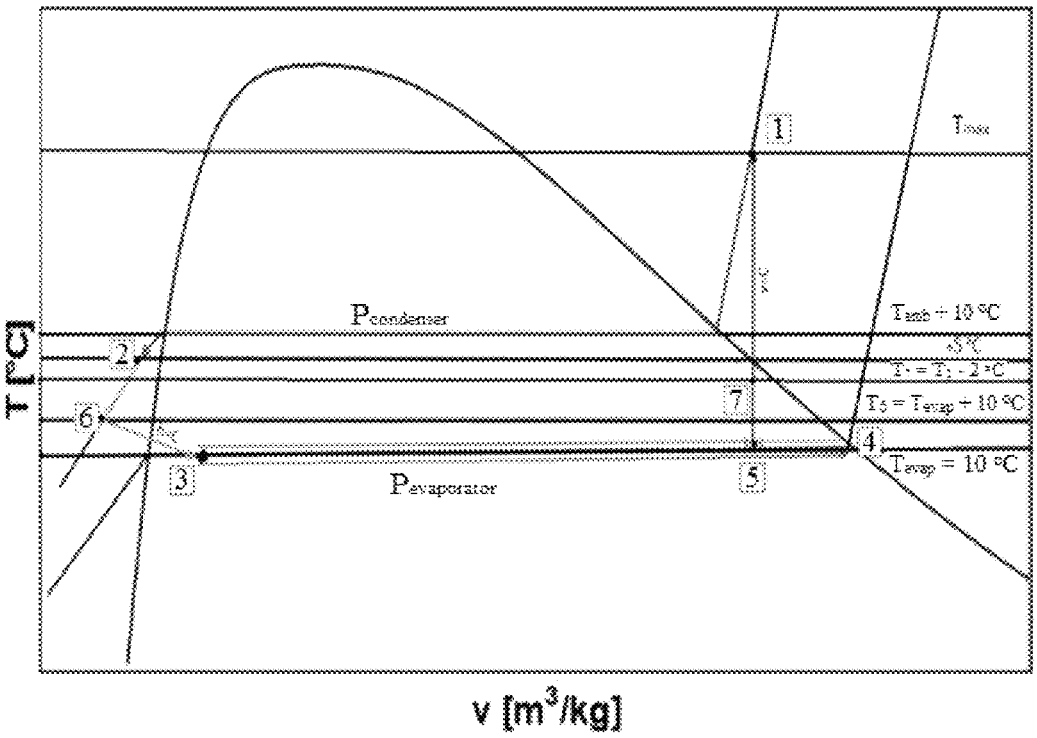
FIG. 2 is a temperature-volume diagram of a refrigeration cycle employing the low-temperature solar-thermal cooling system shown in FIG. 1.

Example 1 Thermodynamic Cycle of the Solar-Thermal Vapor Compression Cooling System The thermodynamic cycle (FIG. 2) comprises seven processes. First, heat rejection by the high pressure, high temperature refrigerant in the condenser to the ambient air, either directly or through a cooling water coil, as indicated by process 1-2 in the diagram, at the constant condenser pressure. Second, cooling the condensate that comes out of the condenser in the condensate heat exchanger (process 2-6) by means of isochoric heating the saturated liquid-vapor mix coming out of the mixing chamber (MC) in the isochoric thermal compressor (third process 5-7). Fourth, throttling the cooled refrigerant condensate in the first and second throttle valves as shown in the diagram by the constant enthalpy process 6-3. Fifth, producing the refrigeration effect by the constant pressure heat addition to the refrigerant in the evaporator as indicated by the process 3-4 in the diagram. Sixth, mixing the produced saturated refrigerant vapor coming out of the evaporator with the throttled remained condensate coming from the refrigerant storage tank in the MC as given in the diagram by both lines 3-5 and 4-5. Seventh, completing the thermodynamic cycle by the second thermal compression step in the heater (using solar energy or waste heat) of the resultant refrigerant saturated vapor-liquid mixture corning out of the MC as given in the diagram by the constant volume process 7-1.

Example 2 Equations Applied to the Cooling Systems Investigated in the Examples Steady-flow conditions are assumed. By applying the conservation of mass (continuity equation) and conservation of energy (first law of thermodynamics) on each component of the system and the system as a whole, the following equations are obtained, where q represents heat, h represents specific enthalpy, u represents specific internal energy, y represents extraction ratio, numeric subscripts correspond to the locations indicated in FIG. 2.

Condenser: $q_{cond}=1\ \text{kg}*(h_1-h_2)$,kJ/kg (1)

Isochoric thermal compressor(*ITC*): $q_{in}=q_{ITC}=1\ \text{kg}*(u_1-u_7)$,kJ/kg (2)

Evaporator: $q_{ref}=y*(h_4-h_6)$,kJ/kg (3)

Whole cycle: Coefficient of performance (COP)$=q_{ref}/q_{ITC}$ (4)

Whole cycle: $q_{cond}=q_{ref}+q_{in}$ (5)

Throttling valves: $h_6=h_3$ (6)

Mixing chamber: $y*h_4+(1-y)*h_3=h_5$ (7)

Gain in refrigeration effect due to cooling the condensate in condensate heat exchanger (CHE): $q_{ref,gain}=(h_2-h_6)*y$ (8)

Decrease in heat input due to the CHE: $q_{in,decrease}=h_7-h_5$ (9)

Coefficient of performance (COP) for the cycle with CHE: [COP]cycle with CHE$=y*(h_4-h_6)/(u_7-u_1)$ (10)

COP for the cycle without CHE: [COP]cycle without CHE$=y*(h_4-h_2)/(u_5-u_1)$ (11)

Gain in COP due to CHE: $\text{COP}_{gain}=[\text{COP}]_{cycle\ with\ CHE}-[\text{COP}]_{cycle\ without\ CHE}=y*(h_4-h_6)/(u_7-u_1)-y*(h_4-h_2)/(u_5-u_1)$ (12)

Example 3 A Refrigeration Cycle without Condensate Heat Exchanger (CHE) and Mixing Chamber (MC)

Figure 3:
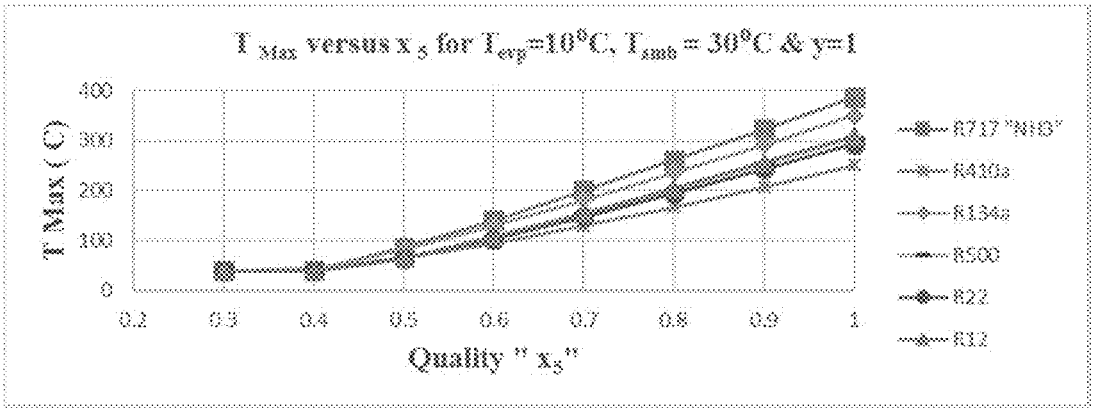
FIG. 3 shows the maximum temperature ($T_{max}$) versus the refrigerant quality ($x_5$) at the entrance to the thermal compressor for various refrigerants in a cycle without both the condensate heat exchanger (CHE) and mixing chamber (MC), for evaporator temperature=10° C. and ambient temperature=30° C.
Figure 4:
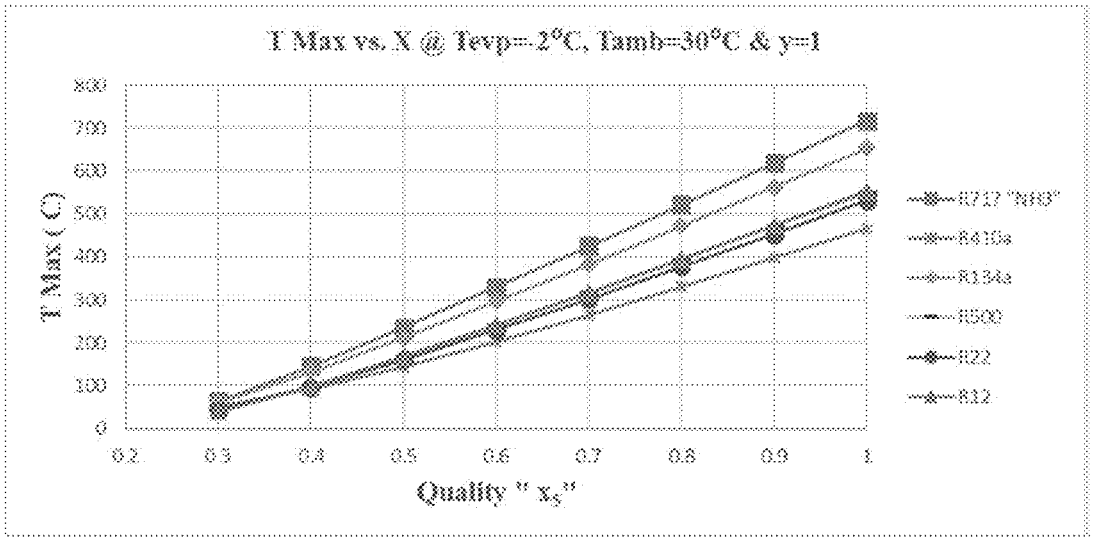
FIG. 4 shows the maximum temperature ($T_{max}$) versus the refrigerant quality ($x_5$) at the entrance to the thermal compressor for various refrigerants in a cycle without both the CHE and MC, for evaporator temperature=2° C. and ambient temperature=30° C.
Figure 5:
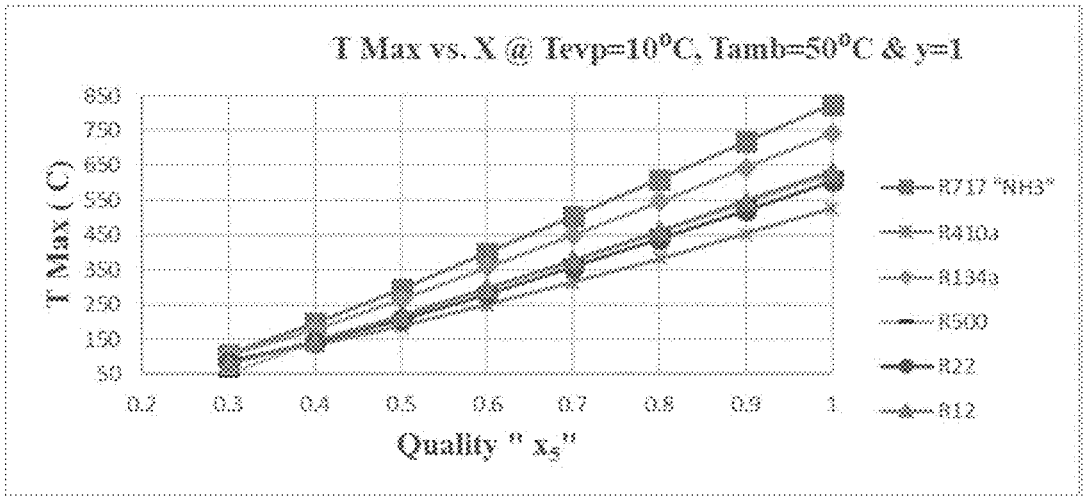
FIG. 5 shows the maximum temperature ($T_{max}$) versus the refrigerant quality ($x_5$) at the entrance to the thermal compressor for various refrigerants in a cycle without both the CHE and MC, for evaporator temperature=10° C. and ambient temperature=50° C.

For comparison with the conventional mechanical vapor compression cycle, which lacks CHE and MC (i.e., no mixing between the extracted condensate and the refrigerant exiting the evaporator and extraction ratio, y=1), a hypothetical refrigeration system without CHE and MC was investigated at full and partial evaporation in the evaporator (to reduce the constant-volume (thermal compression) cycle maximum temperature). At an ambient temperature of 30° C., which represents a typical spring day/mild summer-day at the beginning of summer in Dhahran City, FIG. 3 and FIG. 4, show the variation of the maximum temperature in the cycle at various qualities, $x_5$, of the refrigerant at evaporator temperatures of 10° C. and −2° C., respectively. Similarly, FIG. 5 shows the variation of the maximum temperature in the cycle with the quality of the refrigerant at an evaporator temperature of 10° C. and an ambient temperature of 50° C., which represents a considerably hot summer day in Dhahran and many other cities in the gulf region. The data illustrates when $x_5$ is 1 (i.e. 100% vapor), the maximum cycle temperature ($T_{max}$) ranges from 200-850° C., which is beyond the operating limits of the refrigerants.

Example 4 a Refrigeration Cycle with a Mixing Chamber (MC) but Lacks the Condensate Heat Exchanger (CHE)

Figure 6:
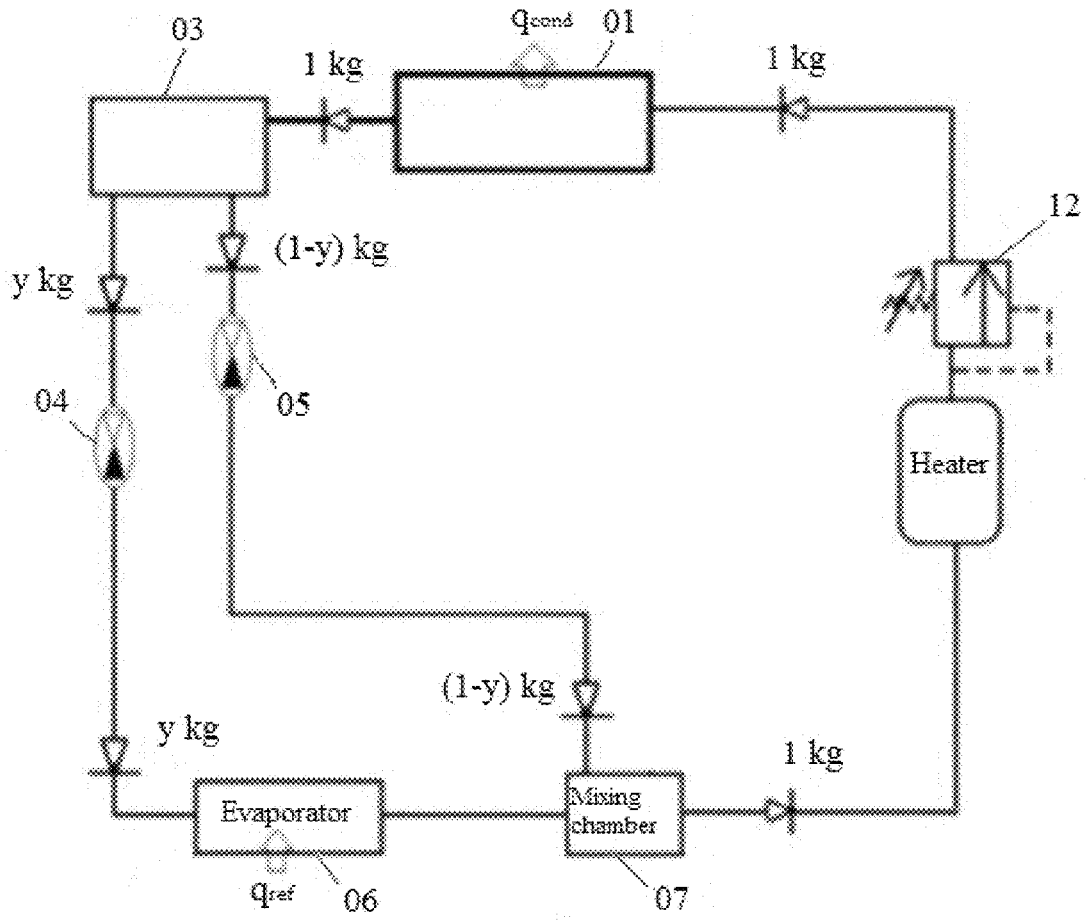
FIG. 6 shows a schematic diagram of a cooling system without a CHE.
Figure 7:
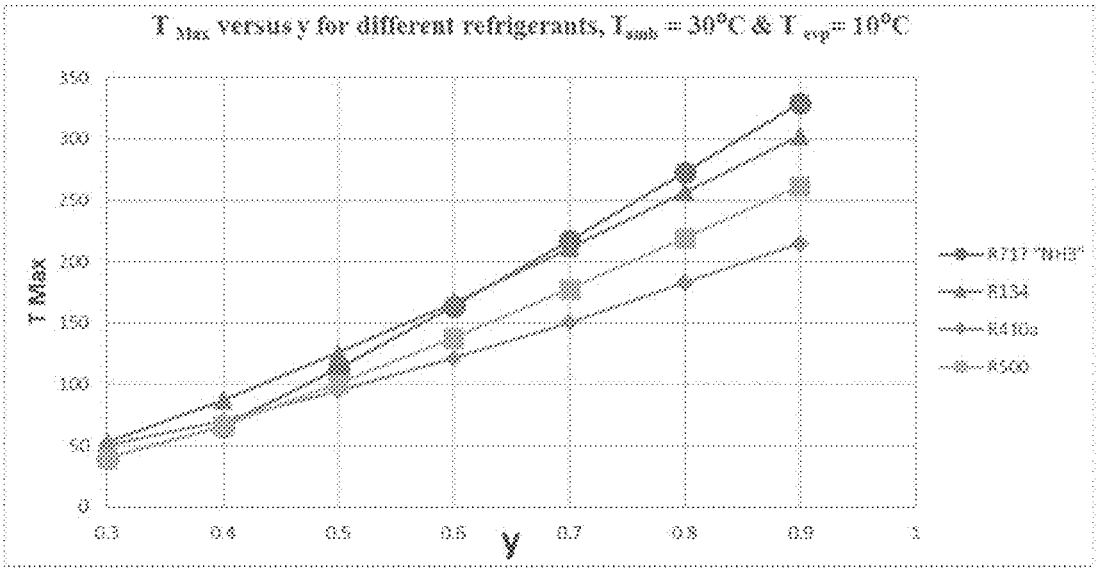
FIG. 7 shows the maximum temperature ($T_{max}$) versus the extraction ratio, y, for various refrigerants in the cooling system shown in FIG. 6, for evaporator temperature=10° C. and ambient temperature=30° C.
Figure 8:
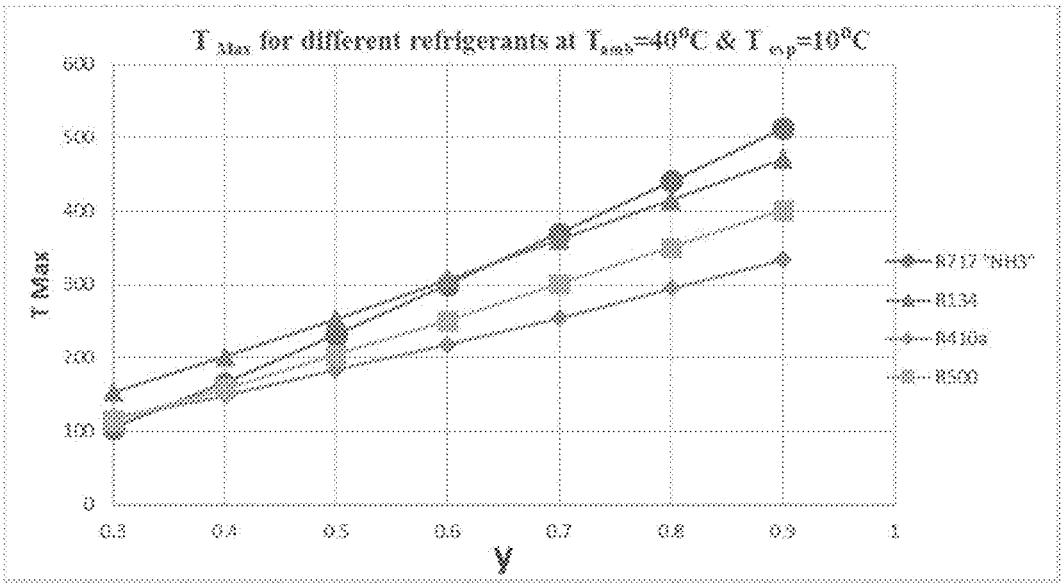
FIG. 8 shows the maximum temperature ($T_{max}$) versus the extraction ratio, y, for various refrigerants in the cooling system shown in FIG. 6, for evaporator temperature=10° C. and ambient temperature=40° C.
Figure 9:
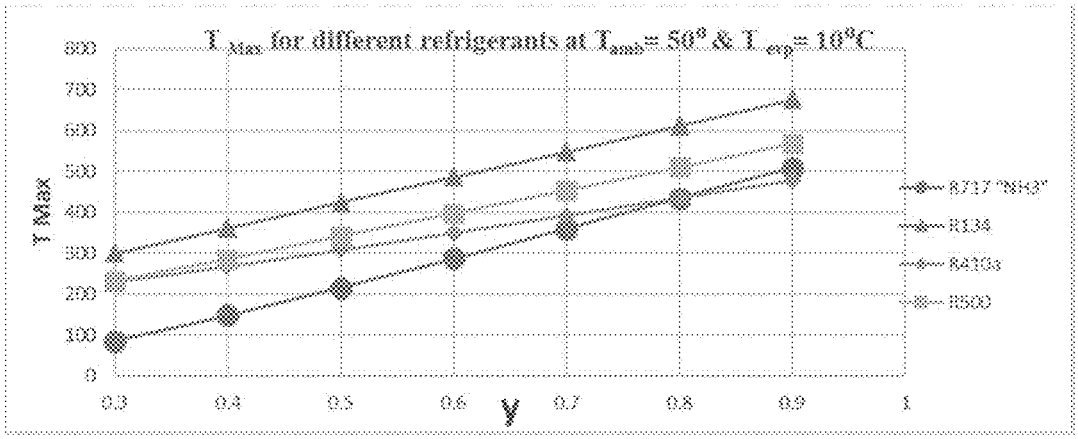
FIG. 9 shows the maximum temperature ($T_{max}$) versus the extraction ratio, y, for various refrigerants in the cooling system shown in FIG. 6, for evaporator temperature=10° C. and ambient temperature=50° C.

The inventors have investigated another refrigeration cycle (FIG. 6) without a CHE but with a MC after the evaporator (for mixing the saturated vapor coming out of the evaporator with the remained condensate coming out from the refrigerant storage tank). The maximum temperatures versus the extraction ratio "y" for various refrigerants and an evaporator temperature of 10° C. at ambient temperatures of 30° C., 40° C. and 50° C. are shown in FIGS. 7, 8 and 9, respectively. These figures show that, in general for a given refrigerant, the maximum cycle temperature ($T_{max}$) increases with the ambient temperature and the extraction ratio, y. For an extreme case with an extraction ratio y=0.9 in a hot summer day of ambient temperature of 50° C., the required $T_{max}$ is 677° C., 569° C., 509.4° C. and 478.9° C. for R134a, R500, R717 and R410a, respectively. Such high maximum cycle temperatures may affect the stability of the refrigerants negatively and are unsuitable for driving the system with a non-concentrating solar collector fields.

However, with y=0.3 at an ambient temperature of 50° C., $T_{max}$ becomes 301.6° C., 232.6° C., 86.4° C. and 229.2° C. for R134a, R500, R717 and R410a, respectively. Thus, at an ambient temperature of 50° C., the system with ammonia refrigerant (R717) and an extraction ratio "y"=0.3 can easily be driven by a low-temperature flat plate solar collector field.

On the other hand, in a spring/mild summer day of ambient temperature 30° C., the corresponding $T_{max}$ for y=0.9 are 302.6° C., 261.8° C., 329.4° C. and 215.2° C. for R134a, R500, R717 and R410a, respectively. However, for y=0.3, the corresponding $T_{max}$ become less than only 53° C. for all these four refrigerants (40° C. for R500, 50.8° C. for 410a, 52.8° C. for 134a and 40° C. for R717). This means that the thermally driven refrigeration system that uses any of these four classical refrigerants can easily be driven by an ordinary flat-plate solar collector field in a spring/mild summer day of 30° C. provided that the extraction ratio y is 0.3. From FIG. 7, it can be seen that this conclusion is also applicable for cases with y up to 0.5. However, FIG. 8 indicates that such use of ordinary flat-plate solar collector field can drive the system in summer day of 40° C. with any of the above four refrigerants if the extraction ratio is less than or equal 0.3. If R134a is excluded, then any of the other three refrigerants can be used for values of y=0.3-0.4.

Figure 10:
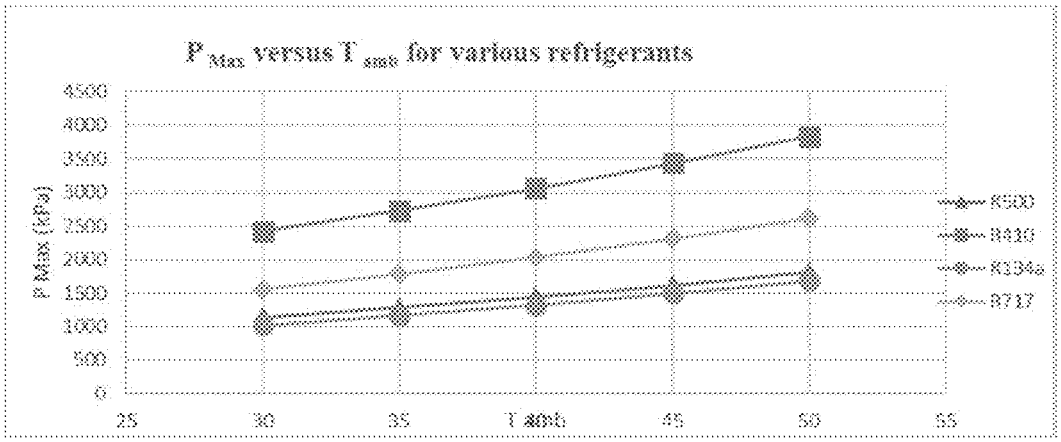
FIG. 10 shows the maximum condenser pressure ($P_{max}$) versus the ambient temperature ($T_{amb}$) for various refrigerants.

The maximum cycle pressure (condenser pressure) is independent of the evaporator temperature, the extraction ratio (y) and $T_{max}$. It only depends on the ambient temperature, as the ambient atmosphere cools the condenser, and the refrigerant used. FIG. 10 shows the condenser pressure as a function of the ambient temperature for the four refrigerants. For a given ambient temperature, R134a has the lowest pressure then R500 with a slight difference between them. On the other hand, R410a requires the highest system pressure followed by ammonia (R717).

Figure 11:
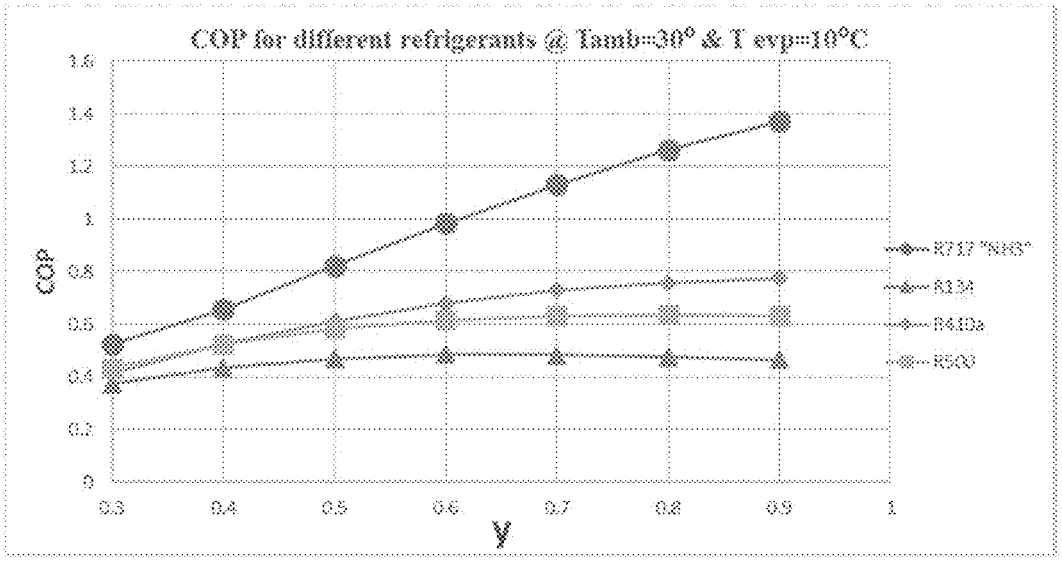
FIG. 11 shows the coefficient of performance (COP) versus extraction ratio, y, for various refrigerants in the cooling system shown in FIG. 6, for evaporator temperature=10° C. and ambient temperature=30° C.
Figure 12:
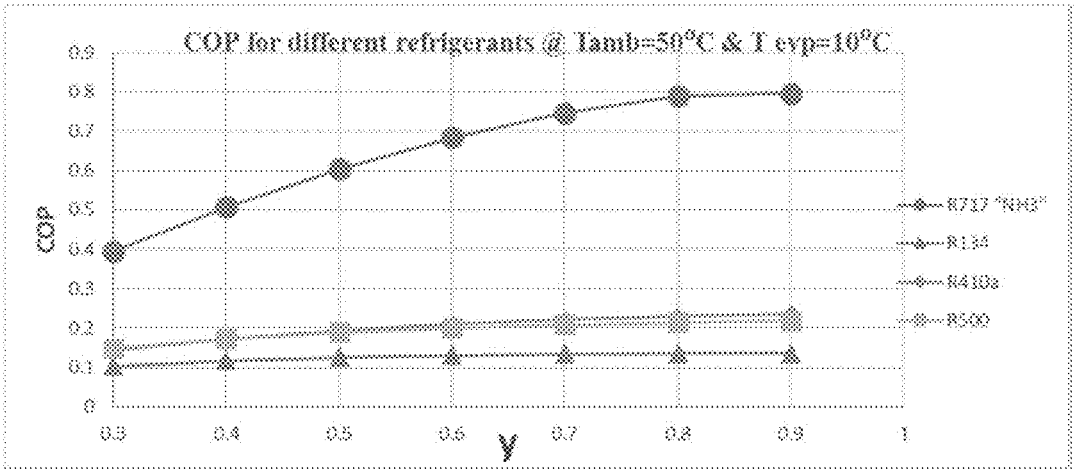
FIG. 12 shows the COP versus extraction ratio, y, for various refrigerants in the cooling system shown in FIG. 6, for evaporator temperature=10° C. and ambient temperature=50° C.

For the cycle with a mixing chamber (MC) after the evaporator but without CHE, FIGS. 11 and 12 show at ambient temperatures of 30° C. and 50° C., respectively, the COP versus extraction ratio (y) for a produced evaporator temperature=10° C. with the same four refrigerants. As anticipated, these three figures show that, for given refrigerant and extraction ratio (y), as the ambient temperature increases the COP decreases. At a given ambient temperature, R717 produced the highest COP while R134a produced the lowest COP. The COP values for R410a and R500 are in between those of R717 and R134a, with R410a having a little advantage over R500.

Figure 13:
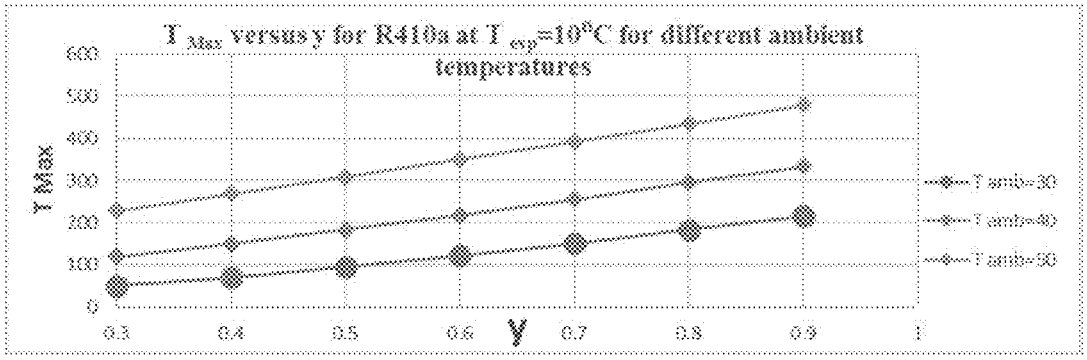
FIG. 13 shows the maximum temperature ($T_{max}$) versus the extraction ratio, y, for R410a in the cooling system shown in FIG. 6 at evaporator temperature ($T_{evp}$) of 10° C. and different ambient temperatures ($T_{amb}$).
Figure 14:
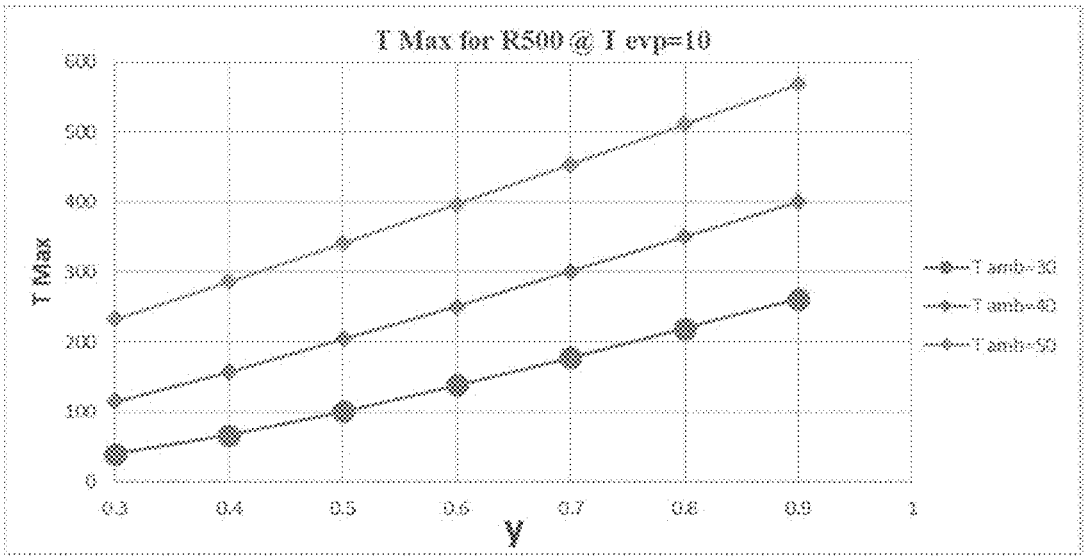
FIG. 14 shows the maximum temperature ($T_{max}$) versus the extraction ratio, y, for R500 in the cooling system shown in FIG. 6 at evaporator temperature ($T_{evp}$) of 10° C. and different ambient temperatures ($T_{amb}$).
Figure 15:
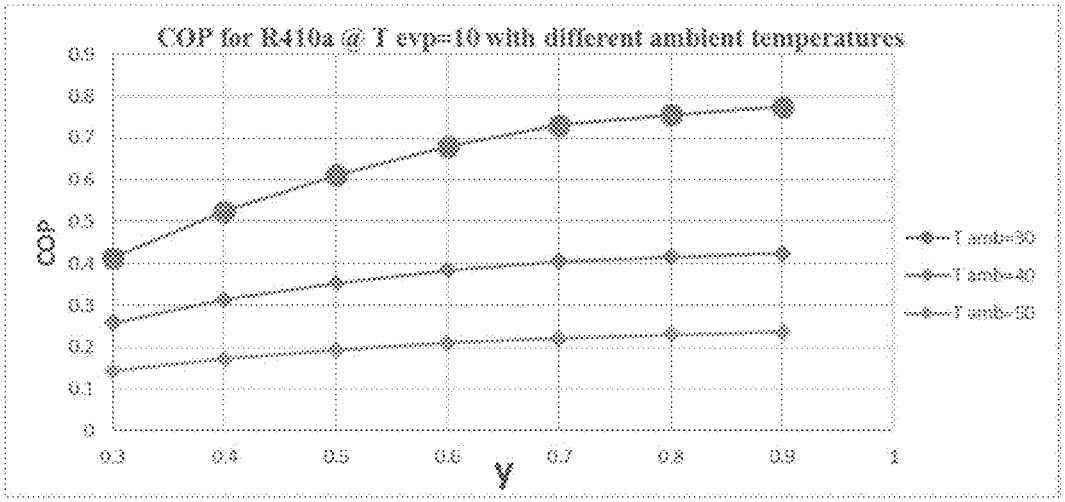
FIG. 15 shows the COP versus the extraction ratio, y, for R410a in the cooling system shown in FIG. 6 at evaporator temperature ($T_{evp}$) of 10° C. and different ambient temperatures ($T_{amb}$).
Figure 16:
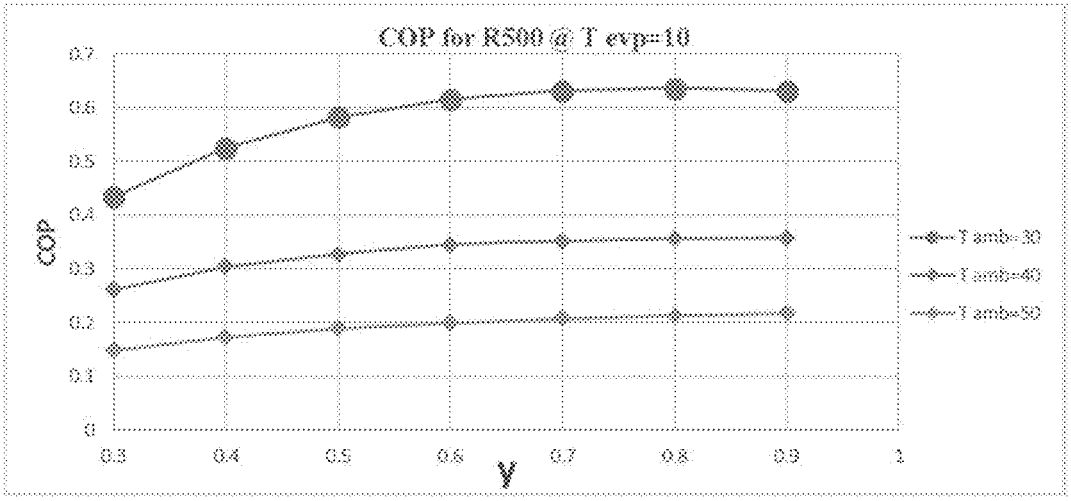
FIG. 16 shows the COP versus the extraction ratio, y, for R500 in the cooling system shown in FIG. 6 at evaporator temperature ($T_{evp}$) of 10° C. and different ambient temperatures ($T_{amb}$).

Thus, even though ammonia (R717) produces the highest COP while R410a and R500 are the most preferred among the four refrigerants for air conditioning applications with non-concentrating flat-plate solar collector fields (ordinary, with selective surface coating, or evacuated tube type). Accordingly, FIGS. 13 and 14 show the detailed results for the maximum temperature versus the extraction ratio (y), while FIGS. 15 and 16 show the corresponding results of COP versus y, at $T_{evp}$=10° C. and different ambient temperatures for these two particular refrigerants. It is worth mentioning that lower maximum temperatures than those presented in these two figures are needed for evaporator temperatures higher than the 10° C. In fact, air conditioners can easily operate with evaporator temperatures higher than 10° C. and hence the two refrigerants (R410a and R500) become more preferable for the thermally driven system in combination with non-concentrating solar collector fields, particularly with low values of the extraction ratio (y).

Example 5 a Refrigeration Cycle with a Mixing Chamber (MC) and a Condensate Heat Exchanger (CHE)

Figure 17:
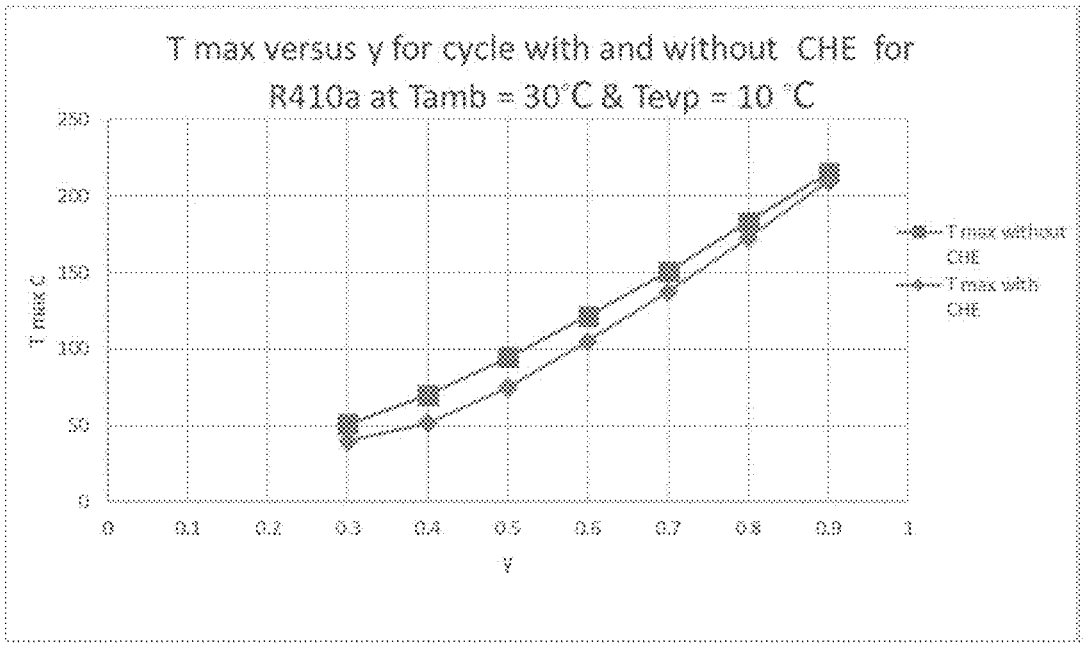
FIG. 17 shows the effect of the CHE on maximum temperature ($T_{max}$) for R410a, at evaporator temperature ($T_{evp}$) of 10° C. and ambient temperature ($T_{amb}$) of 30° C.
Figure 18:
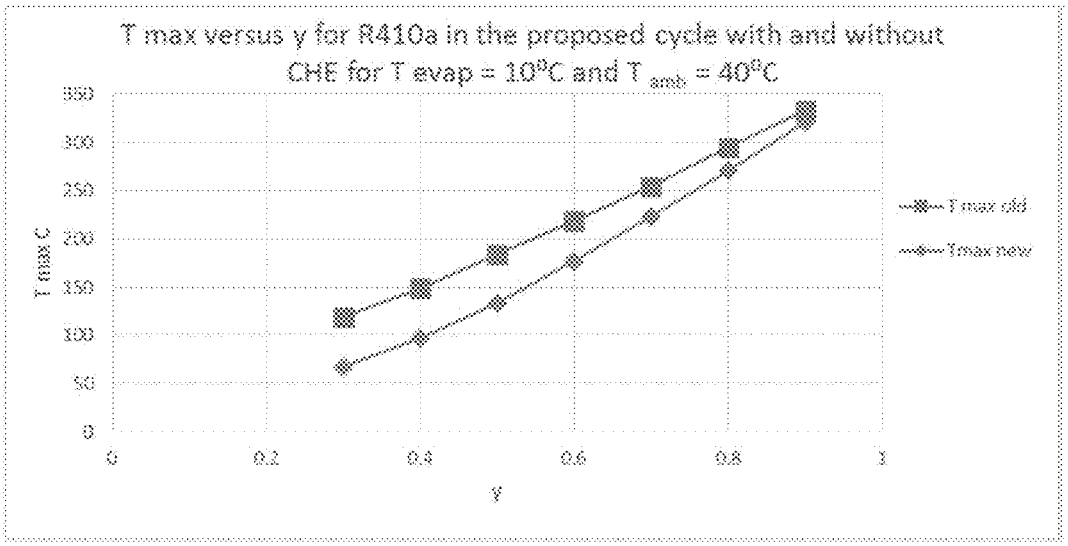
FIG. 18 shows the effect of the CHE on maximum temperature ($T_{max}$) for R410a, at evaporator temperature ($T_{evp}$) of 10° C. and ambient temperature ($T_{amb}$) of 40° C.
Figure 19:
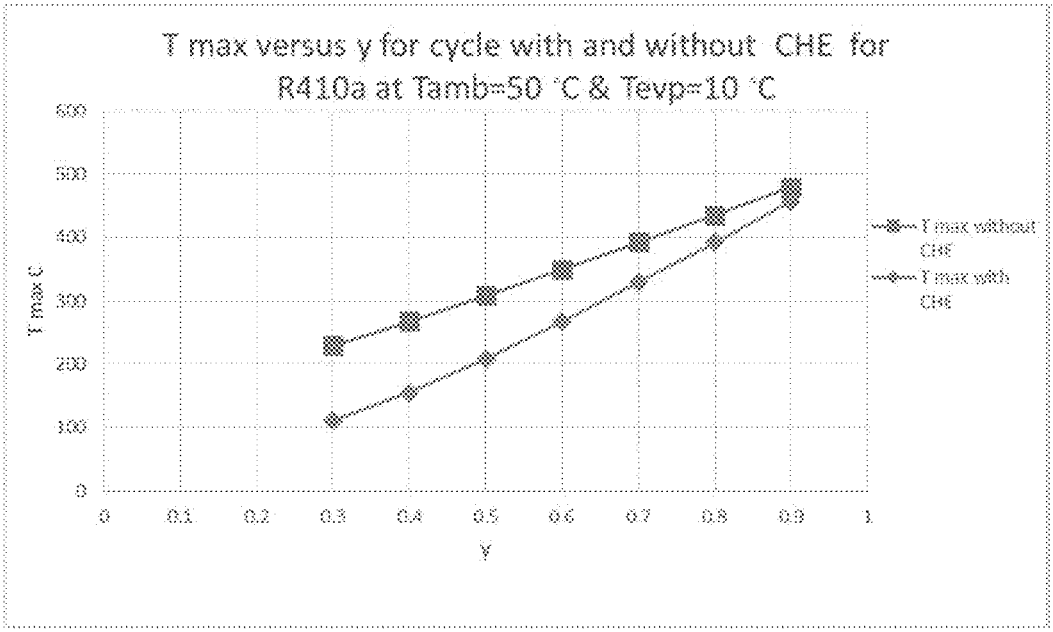
FIG. 19 shows the effect of the CHE on maximum temperature ($T_{max}$) for R410a, at evaporator temperature ($T_{evp}$) of 10° C. and ambient temperature ($T_{amb}$) of 50° C.
Figure 20:
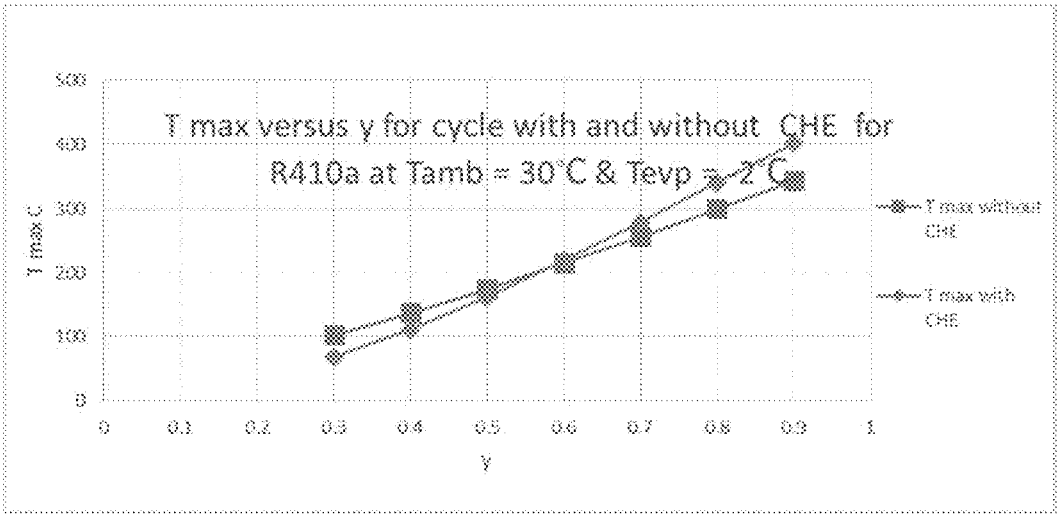
FIG. 20 shows the effect of the CHE on $T_{max}$ for R410a, at evaporator temperature ($T_{evp}$) of −2° C. and ambient temperature ($T_{amb}$) of 30° C.
Figure 21:
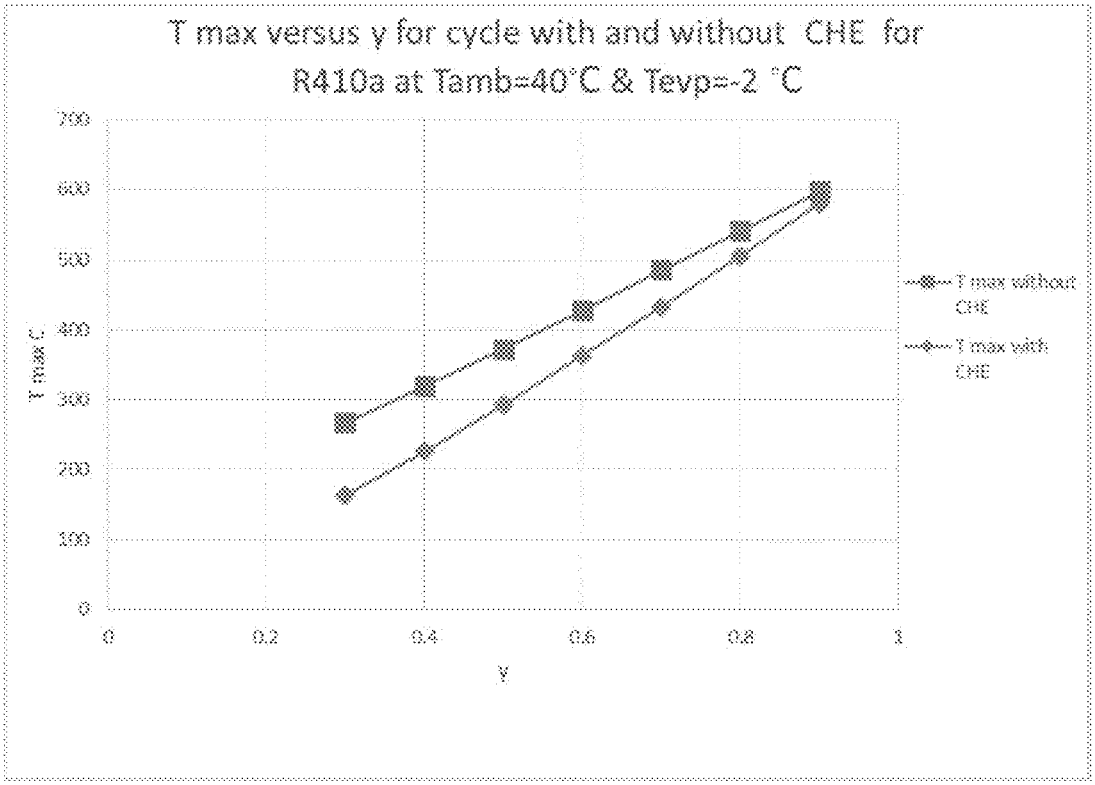
FIG. 21 shows the effect of the CHE on $T_{max}$ for R410a, at evaporator temperature ($T_{evp}$) of −2° C. and ambient temperature ($T_{amb}$) of 40° C.
Figure 22:
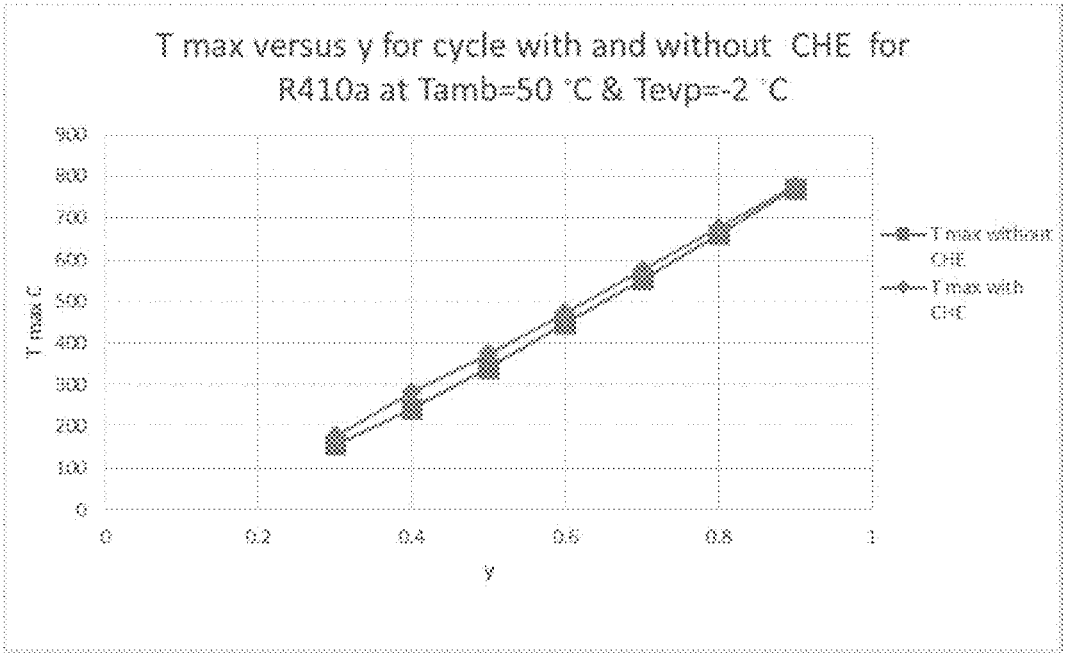
FIG. 22 shows the effect of the CHE on $T_{max}$ for R410a, at evaporator temperature ($T_{evp}$) of −2° C. and ambient temperature ($T_{amb}$) of 50° C.
Figure 23:
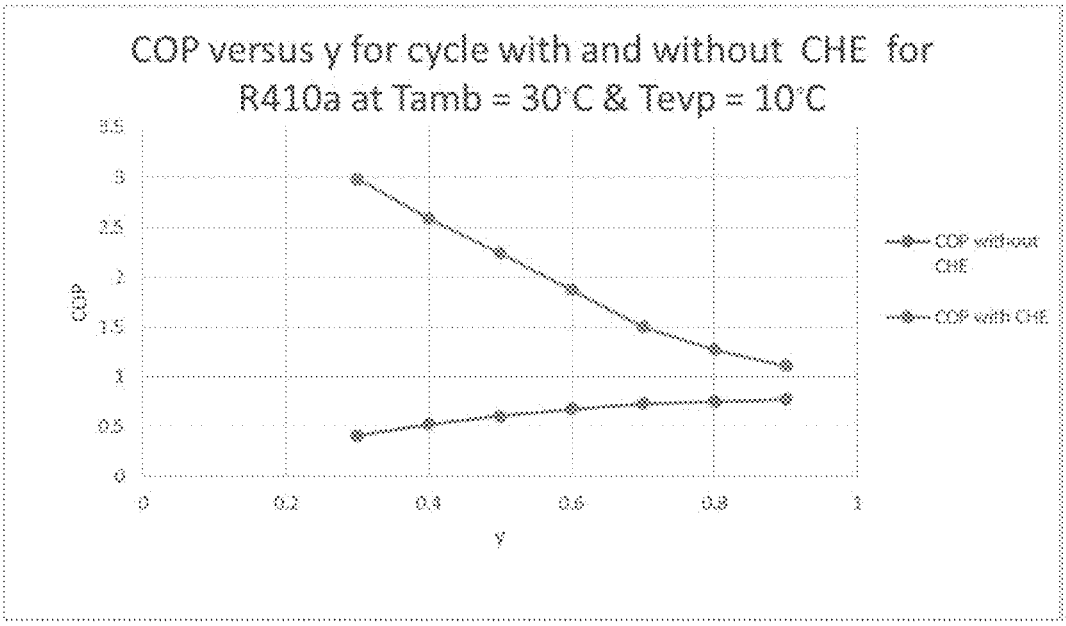
FIG. 23 shows the effect of the CHE on COP versus y for R410a, at evaporator temperature ($T_{evp}$) of 10° C. and ambient temperature ($T_{amb}$) of 30° C.
Figure 25:
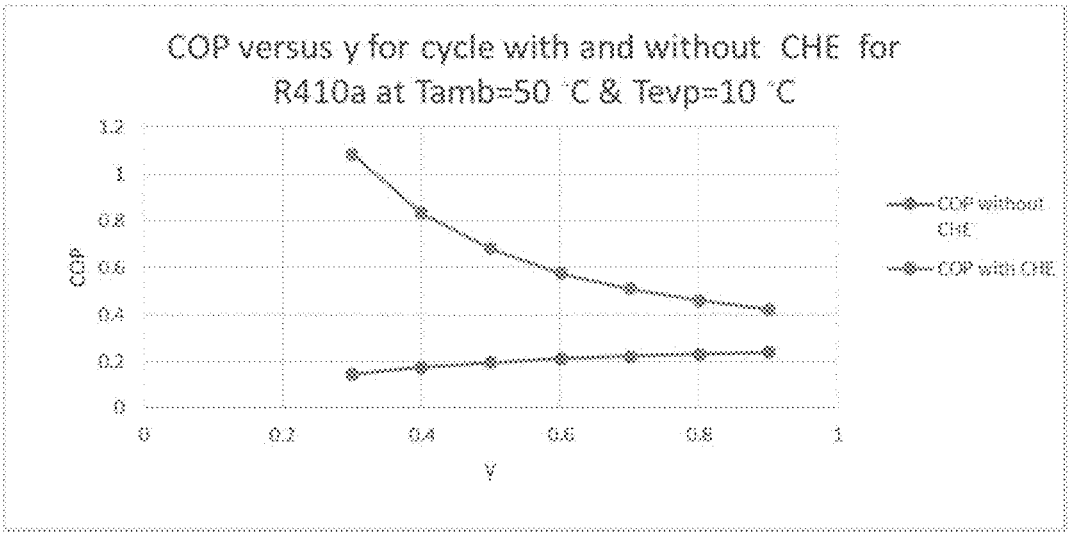
FIG. 25 shows the effect of the CHE on COP versus y for R410a, at evaporator temperature ($T_{evp}$) of 10° C. and ambient temperature ($T_{amb}$) of 50° C.
Figure 26:
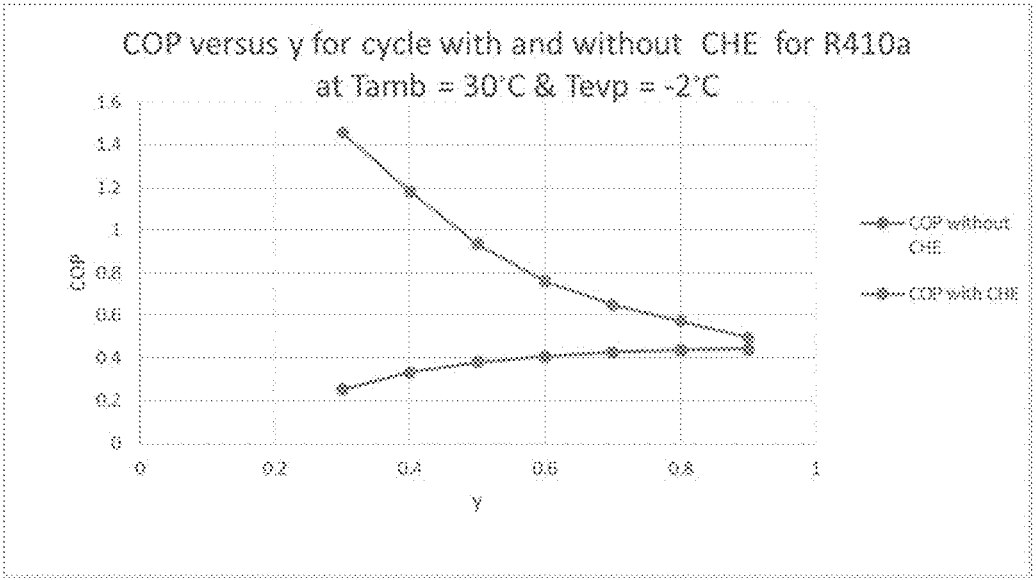
FIG. 26 shows the effect of the CHE on COP versus y for R410a, at evaporator temperature ($T_{evp}$) of −2° C. and ambient temperature ($T_{amb}$) of 30° C.
Figure 27:
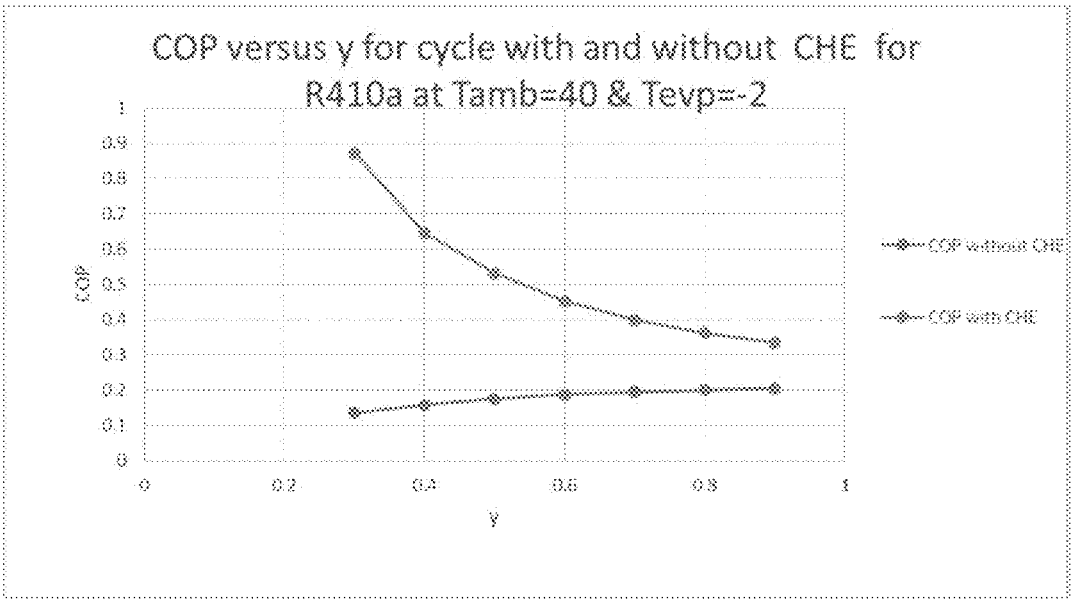
FIG. 27 shows the effect of the CHE in the cycle on COP versus y for R410a, at evaporator temperature ($T_{evp}$) of −2° C. and ambient temperature ($T_{amb}$) of 40° C.
Figure 28:
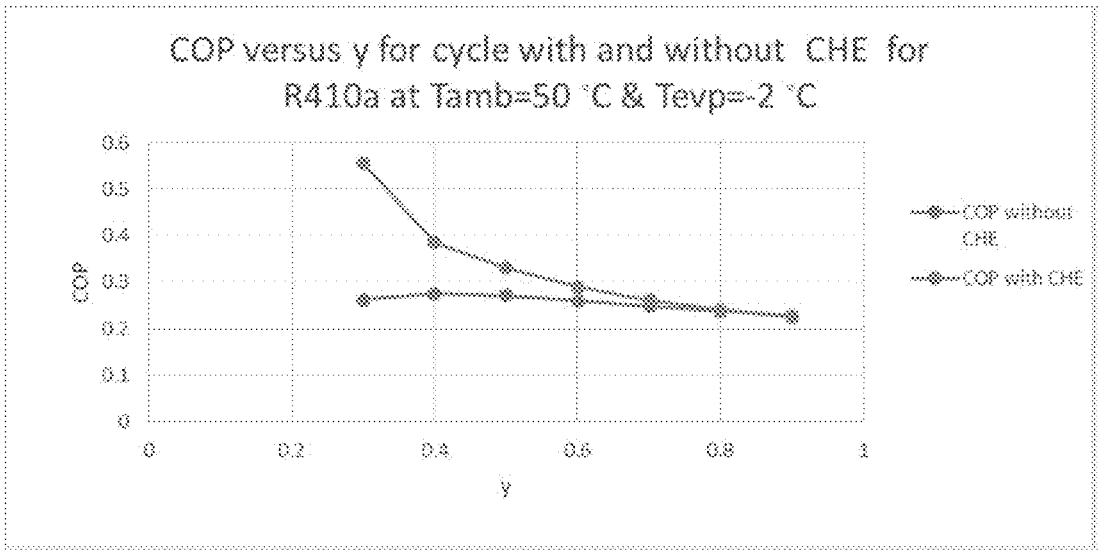
FIG. 28 shows the effect of the CHE in the cycle on COP versus y for R410a at evaporator temperature ($T_{evp}$) of −2° C. and ambient temperature ($T_{amb}$) of 50° C.
Figure 29:
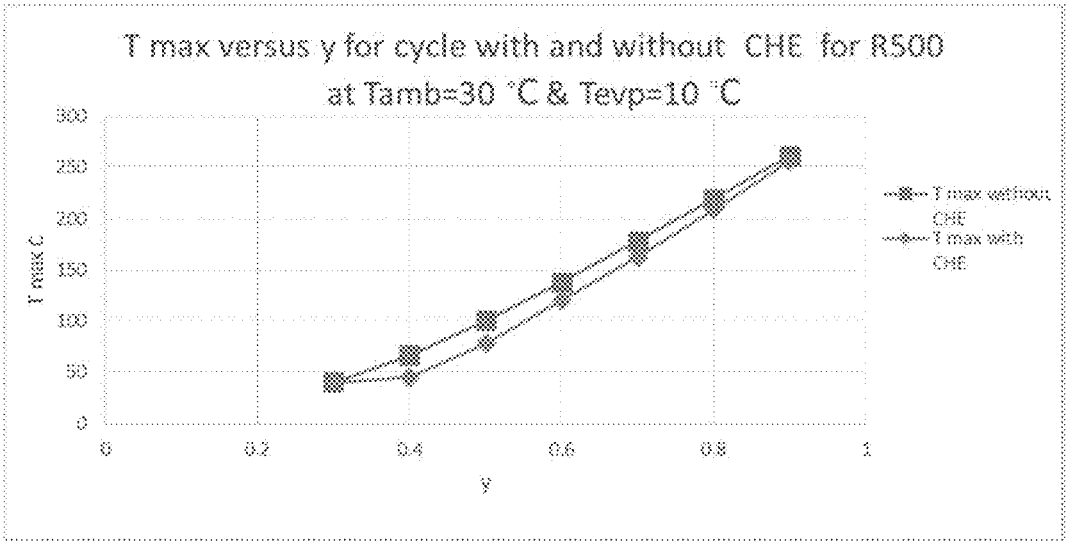
FIG. 29 shows the maximum temperature ($T_{max}$) versus y for R500 in a cycle with and without the CHE, at evaporator temperature ($T_{evp}$) of 10° C. and ambient temperature ($T_{amb}$) of 30° C.
Figure 30:
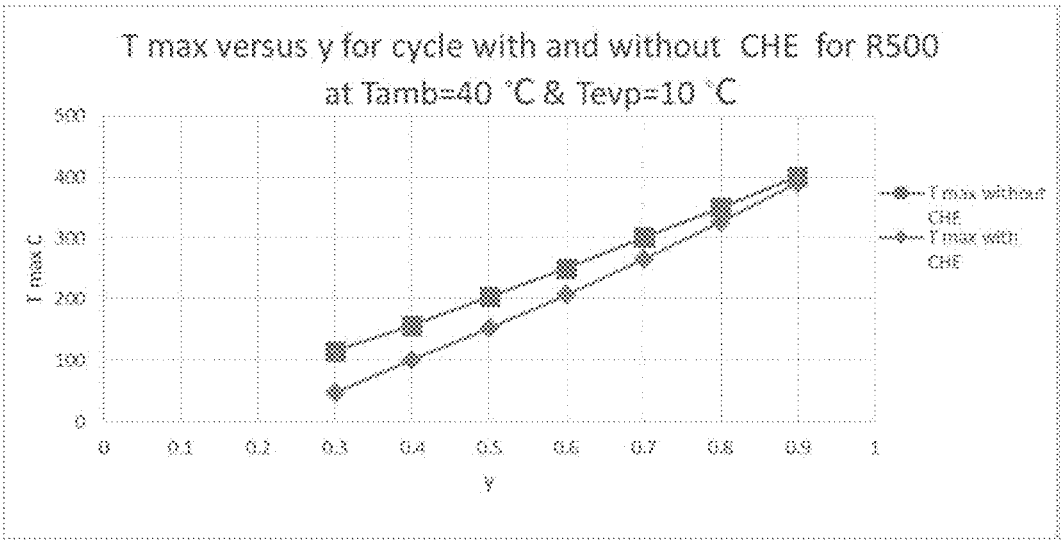
FIG. 30 shows the maximum temperature ($T_{max}$) versus y for R500 in a cycle with and without CHE, at evaporator temperature ($T_{evp}$) of 10° C. and ambient temperature ($T_{amb}$) of 40° C.
Figure 31:
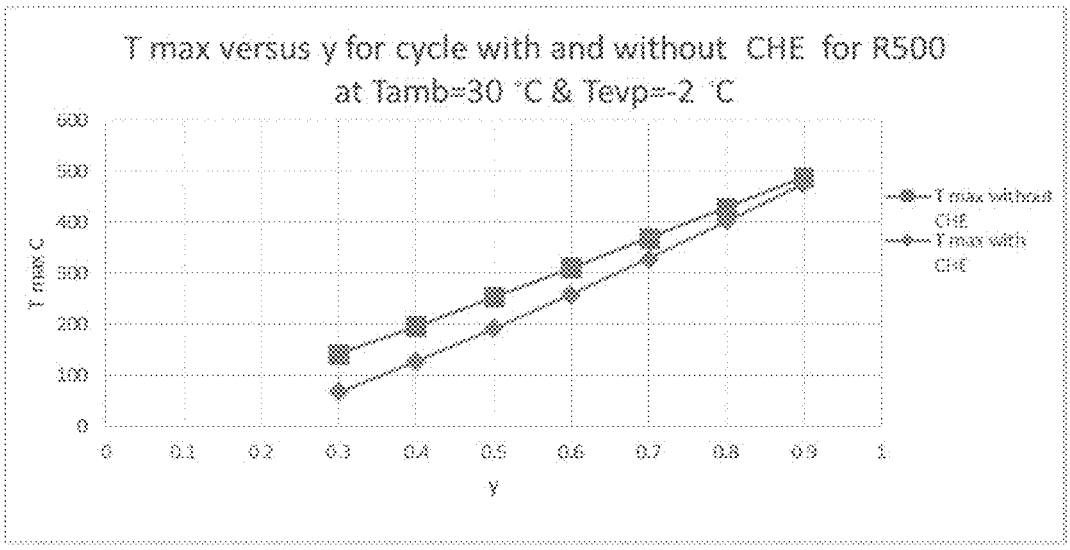
FIG. 31 shows the maximum temperature ($T_{max}$) versus y for R500 in a cycle with and without CHE, at evaporator temperature ($T_{evp}$) of −2° C. and ambient temperature ($T_{amb}$) of 30° C.
Figure 32:
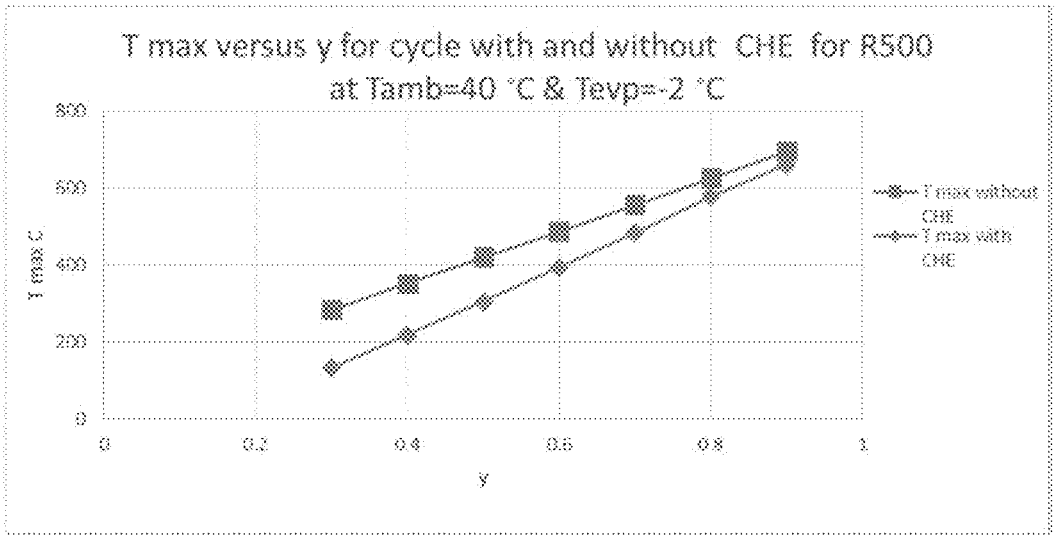
FIG. 32 shows the maximum temperature ($T_{max}$) versus y for R500 in a cycle with and without the CHE, at evaporator temperature ($T_{evp}$) of −2° C. and ambient temperature ($T_{amb}$) of 40° C.
Figure 33:
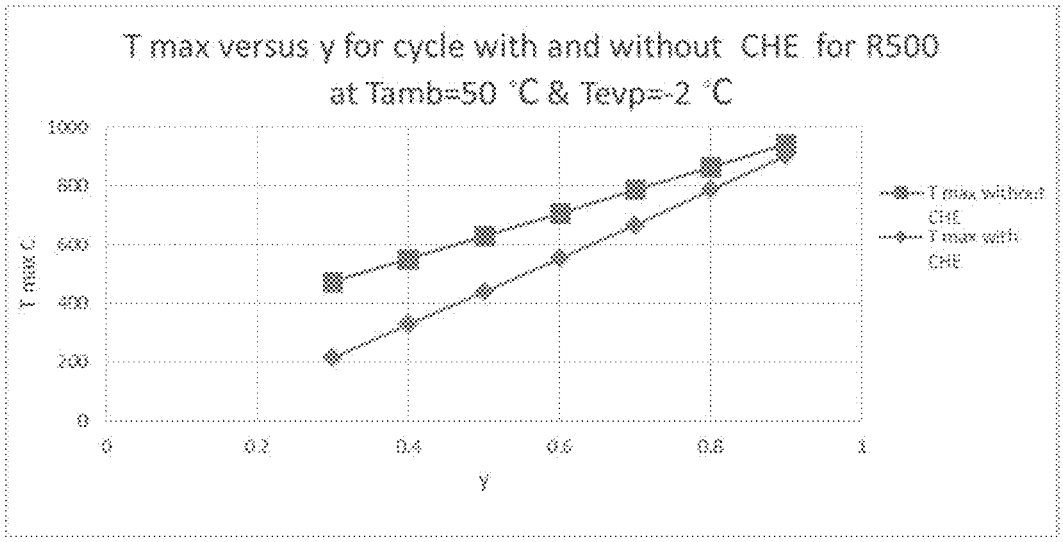
FIG. 33 shows the maximum temperature ($T_{max}$) versus y for R500 in a cycle with and without the CHE, at evaporator temperature ($T_{evp}$) of −2° C. and ambient temperature ($T_{amb}$) of 50° C.
Figure 34:
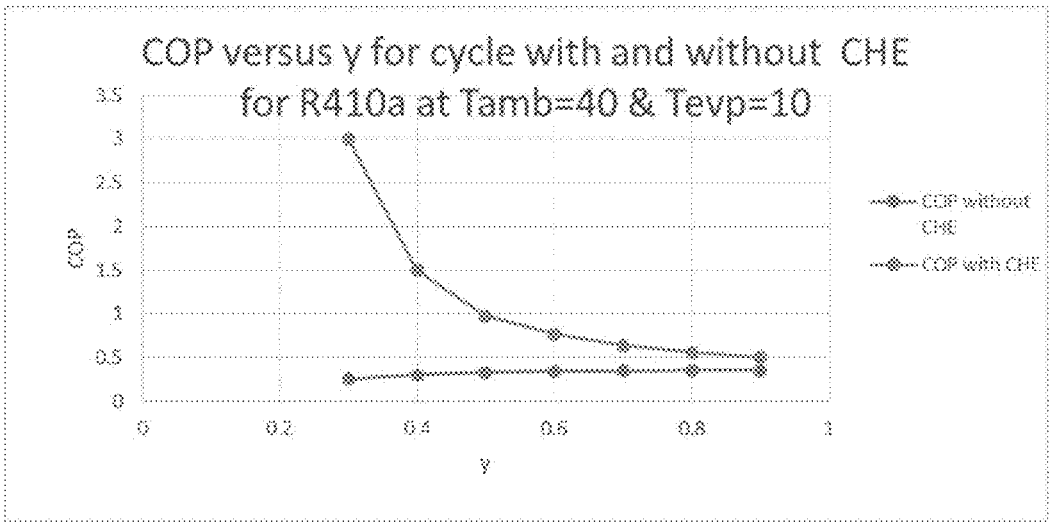
FIG. 34 shows the COP versus y for R500 in the cycle with and without the CHE, at evaporator temperature ($T_{evp}$) of 10° C. and ambient temperature ($T_{amb}$) of 40° C.
Figure 35:
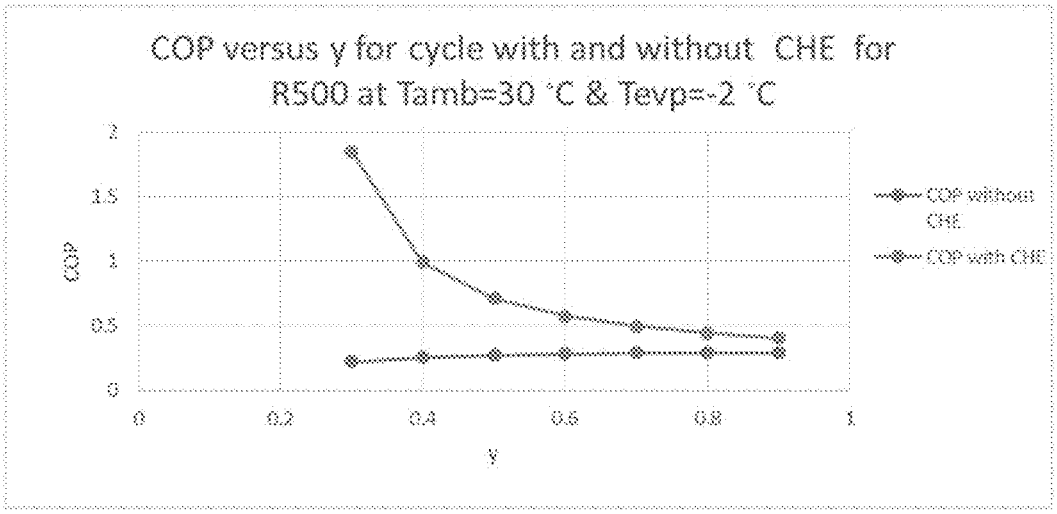
FIG. 35 shows the COP versus y for R500 in the cycle with and without the CHE, at evaporator temperature ($T_{evp}$) of −2° C. and ambient temperature ($T_{amb}$) of 30° C.
Figure 36:
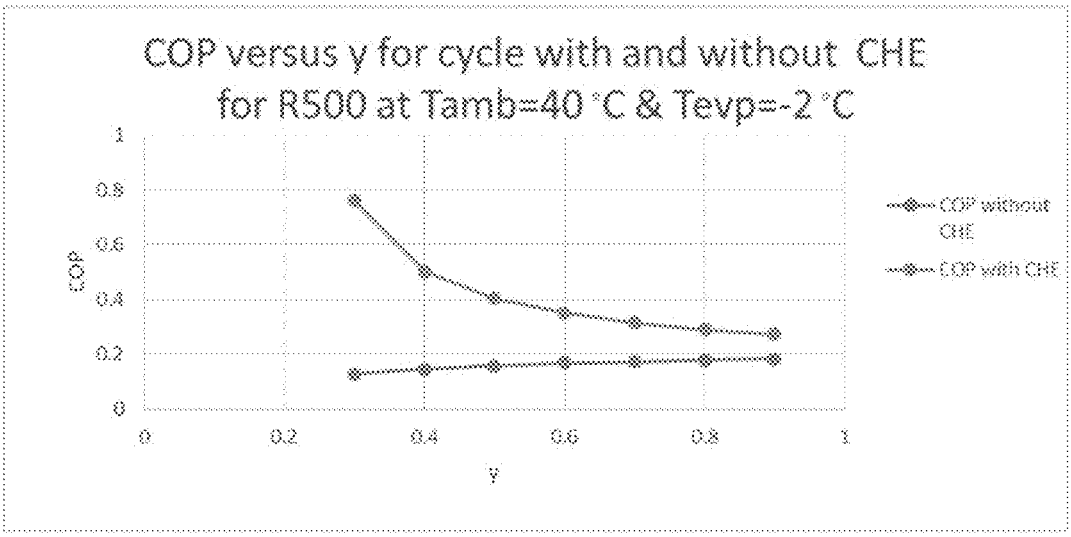
FIG. 36 shows the COP versus y for R500 in the cycle with and without the CHE, at evaporator temperature ($T_{evp}$) of −2° C. and ambient temperature ($T_{amb}$) of 40° C.
Figure 37:
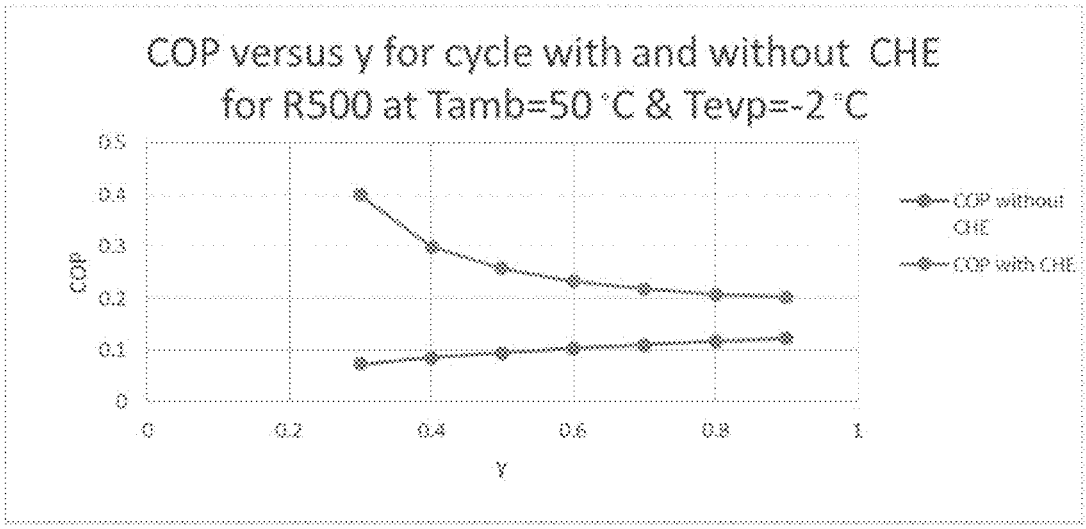
FIG. 37 shows the COP versus y for R500 in the cycle with and without the CHE, at evaporator temperature ($T_{evp}$) of −2° C. and ambient temperature ($T_{amb}$) of 50° C.

The introduction of a CHE improves the performance of the present disclosure considerably; it reduces its required maximum temperature (hence increases the possibility of using ordinary flat plate collectors to drive the system) and increases its COP because of the decrease in the required driving thermal energy input for a refrigeration output per unit mass. For R410a, FIGS. 17-19 show the effect of introducing the CHE into the cycle on decreasing the maximum cycle temperature for an evaporator temperature of 10° C. while FIGS. 20-22 show such an effect for the evaporator temperature of −2° C. FIGS. 23-25 show the effect of introducing the CHE into the cycle on increasing the COP of the cycle for an evaporator temperature of 10° C. while FIGS. 26-28 show such an effect for the evaporator temperature of −2° C. FIGS. 29-36 show some of the corresponding results for R500. A common conclusion of the results shown in these figures is that, provided the designer selects a low value of y, both refrigerants R410a and R500 are good candidates for use with the system in low-temperature solar thermal air conditioning applications.

For refrigeration applications, such as preservation of fruits and vegetables, the results indicate that the cycle in FIG. 1, when driven by a parabolic dish solar concentrator, is compatible with many known refrigerants. However, in such refrigeration applications, the solar collector fields, preferably of the non-concentrating flat-plate type, can still drive the cycle when using R410a or R500 as the working substance if the ambient temperature is less than 40° C. and the extraction ratio, y, is below 0.4.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A solar thermal cooling system comprising:

a refrigerant storage tank, which stores a refrigerant liquid;

an evaporator, which receives and evaporates a first portion of the refrigerant liquid from the refrigerant storage tank to form a refrigerant vapor;

a mixing chamber, which receives the refrigerant vapor from the evaporator and a second portion of the refrigerant liquid from the refrigerant storage tank, wherein the refrigerant vapor and the second portion of the refrigerant liquid are mixed to form a mixture;

a conduit fluidly connecting the refrigerant storage tank and the mixing chamber, wherein the conduit consists of a plurality of check valves and a first throttle valve, wherein the first throttle valve regulates a volume of the second portion of the refrigerant liquid flowing to the mixing chamber;

an isochoric thermal compressor comprising a condensate heat exchanger and a heating coil fluidly connected to a solar collector field, wherein the isochoric thermal compressor receives the mixture from the mixing chamber and compresses the mixture by heating the mixture to form a compressed refrigerant; and a condenser, which is located between the isochoric thermal compressor and the refrigerant storage tank, wherein the condenser receives and condenses the compressed refrigerant to form a condensate that flows through the condensate heat exchanger to the refrigerant storage tank;

wherein the condenser, the isochoric thermal compressor, the refrigerant storage tank, the evaporator, the mixing chamber are fluidly connected to one another, and the mixing chamber and the evaporator are connected in parallel to the refrigerant storage tank.

2. The system of claim 1, wherein the condenser has a working temperature ranging from 40-60° C.

3. The system of claim 1, wherein the refrigerant vapor and the refrigerant liquid are a blend of fluorocarbons, chlorofluorocarbons, or both.

4. The system of claim 1, wherein the system operates in a temperature up to 50° C.

5. The system of claim 1, wherein the system produces a temperature ranging from −2-10° C.

6. The system of claim 1, further comprising a temperature control valve located between the solar collector field and the heating coil, wherein the temperature control valve controls a volume of a heating fluid flowing from the solar collector field to the heating coil.

7. The system of claim 1, further comprising a pressure relief valve located between the isochoric thermal compressor and the condenser.

8. The system of claim 1, further comprising a second throttle valve located between the refrigerant storage tank and the evaporator, wherein the second throttle valve regulates a volume of the first portion of the refrigerant liquid flowing to the evaporator.

9. The system of claim 1, further comprising a check valve located between the mixing chamber and the isochoric thermal compressor to permit the mixture to only flow toward the isochoric thermal compressor.

10. The system of claim 1, wherein there are two check valves in the conduit, a first check valve is located between the refrigerant storage tank and the first throttle valve, and a second check valve is located between the first throttle valve and the mixing chamber.

11. The system of claim 1, wherein the refrigerant vapor and the second portion of the refrigerant liquid are mixed by a stirrer to form the mixture.

12. The system of claim 1, wherein a quality of the refrigerant is in a range of 0.1-0.5, wherein the quality is a mass fraction of the mass of the refrigerant vapor to a total mass of the mixture.

13. The system of claim 12, wherein the quality of the refrigerant is in a range of 0.2-0.45.

14. A solar thermal cooling method for producing a refrigeration effect, comprising:

storing a refrigerant liquid in a refrigerant storage tank;

evaporating a first portion of the refrigerant liquid in an evaporator to form a refrigerant vapor and to provide the refrigeration effect;

flowing a volume of a second portion of the refrigerant liquid from the refrigerant storage tank through a conduit to a mixing chamber, wherein the conduit fluidly connects the refrigerant storage tank and the mixing chamber, and the conduit consists of a plurality of check valves and a first throttle valve;

mixing the volume of the second portion of the refrigerant liquid with the refrigerant vapor in the mixing chamber to form a mixture, wherein the mixing chamber is fluidly connected to the evaporator, and the mixing chamber and the evaporator are fluidly connected in parallel to the refrigerant storage tank;

compressing the mixture into a compressed refrigerant in an isochoric thermal compressor comprising a condensate heat exchanger and a heating coil, which is fluidly connected to a solar collector field;

condensing the compressed refrigerant in a condenser to form a condensate, which flows through the condensate heat exchanger to the refrigerant storage tank.

15. The method of claim 14, wherein the condenser has a working temperature ranging from 40-60° C.

16. The method of claim 14, wherein the system operates in a temperature ranging from −2-10° C.

17. The method of claim 14, wherein the refrigerant vapor and the refrigerant liquid are a blend of fluorocarbons, chlorofluorocarbons, or both.

18. The method of claim 14, further comprising flowing a volume of a heating fluid from the solar collector field to the heating coil and controlling the volume with a temperature control valve located between the solar collector field and the heating coil.

19. The method of claim 14, further comprising flowing a volume of the first portion of the refrigerant liquid to the evaporator and regulating the volume with a second throttle valve.

* * * * *